US010532386B2

(12) United States Patent
Mizoguchi et al.

(10) Patent No.: US 10,532,386 B2
(45) Date of Patent: Jan. 14, 2020

(54) CONTINUOUS-CAST SLAB, METHOD AND APPARATUS OF MANUFACTURING THE SAME, AND METHOD AND APPARATUS OF MANUFACTURING THICK STEEL PLATE

(71) Applicant: NIPPON STEEL & SUMITOMO METAL CORPORATION, Tokyo (JP)

(72) Inventors: Toshiaki Mizoguchi, Kashima (JP); Hiroaki Uchiyama, Tokai (JP); Hideaki Sakurai, Kimitsu (JP); Ryousuke Takata, Tokai (JP); Shinji Nagai, Tomisato (JP); Shuntaro Imai, Kisarazu (JP); Daisuke Sakai, Tokai (JP)

(73) Assignee: NIPPON STEEL CORPORATION, Tokyo (JP)

( * ) Notice: Subject to any disclaimer, the term of this patent is extended or adjusted under 35 U.S.C. 154(b) by 351 days.

(21) Appl. No.: 15/540,355

(22) PCT Filed: Jan. 13, 2016

(86) PCT No.: PCT/JP2016/050876

§ 371 (c)(1),
(2) Date: Jun. 28, 2017

(87) PCT Pub. No.: WO2016/114319

PCT Pub. Date: Jul. 21, 2016

(65) Prior Publication Data

US 2018/0009015 A1 Jan. 11, 2018

(30) Foreign Application Priority Data

Jan. 15, 2015 (JP) ..... 2015-005945
Feb. 20, 2015 (JP) ..... 2015-031343

(51) Int. Cl.
*B21B 31/20* (2006.01)
*B21B 1/46* (2006.01)
(Continued)

(52) U.S. Cl.
CPC ..... *B21B 1/463* (2013.01); *B21B 1/026* (2013.01); *B22D 11/009* (2013.01); *B21B 2001/028* (2013.01); *B21B 2261/04* (2013.01)

(58) Field of Classification Search
CPC ... B21B 1/463; B21B 1/026; B21B 2001/028; B21B 2261/04; B22D 11/009
(Continued)

(56) References Cited

U.S. PATENT DOCUMENTS 3,358,358 A * 12/1967 Jenks ..... B21B 1/463 164/476
2009/0049882 A1* 2/2009 Flick ..... B21B 1/463 72/240
2018/0009015 A1* 1/2018 Mizoguchi ..... B22D 11/128

FOREIGN PATENT DOCUMENTS

JP 07-227658 8/1995
JP 2001-334353 12/2001
JP 2009-279652 12/2009

* cited by examiner

*Primary Examiner* — David B Jones
(74) *Attorney, Agent, or Firm* — Clark & Brody

(57) ABSTRACT

A continuous-cast slab is provided where central porosity is reduced by surly crushing the slab. A method and apparatus of manufacturing the slab is also provided. The continuous-cast slab having horizontally symmetrical granular equiaxed crystals at least in the center in the thickness direction includes a first reduction dent and a second reduction dent that further dents from the bottom surface of the first reduction dent and is narrower than the first reduction dent at least on one long side surface. Such a configuration can makes it possible to achieve the continuous-cast slab of no more than $2.5\times10^{-4}$ $cm^3/g$ in a maximum porosity volume while segregation is reduced.

17 Claims, 10 Drawing Sheets

(51) Int. Cl.
*B21B 1/02* (2006.01)
*B22D 11/00* (2006.01)

(58) Field of Classification Search
USPC ..... 72/234
See application file for complete search history.

CONTINUOUS-CAST SLAB, METHOD AND APPARATUS OF MANUFACTURING THE SAME, AND METHOD AND APPARATUS OF MANUFACTURING THICK STEEL PLATE

TECHNICAL FIELD

The present invention relates to a continuous-cast slab, a method and apparatus of manufacturing the same, and a method and apparatus of manufacturing a thick steel plate. Particularly, the present invention relates to: a continuous-cast slab where central porosity and segregation, which inevitably form in the center of a cast slab, are reduced, a method and apparatus of manufacturing the same; and a method and apparatus of manufacturing a thick steel plate of a few flaws under ultrasonic testing, manufactured using the continuous-cast slab and used for a nuclear reactor, a boiler, a pressure vessel and so on.

BACKGROUND ART

An outer surface, which is supported by support rolls, of a cast slab solidifies first upon cast in continuous casting equipment. Thus, the center of the casting thickness (in the cast slab thickness direction) solidifies last. In addition, when molten steel solidifies, volume shrinkage of 3 to 4% occurs. Therefor, a micro-cavity that is called central porosity inevitably forms in the cast slab center which solidifies last. This central porosity remains even after rolling, and can be detected under ultrasonic testing in the stage of a thick steel plate. Internal flaws caused by this central porosity are harmful especially according to a use of a nuclear reactor, a boiler, a pressure vessel or the like. Thus, to reduce the central porosity volume in a cast slab is conventionally carried out.

Segregation is easy to form in addition to porosity in the cast slab center which solidifies last. Especially, it is difficult to reduce both the porosity volume and segregation at the same time in a slab having granular equiaxed crystals in its center. The following are some reasons considered: (1) segregation is easy to form around granular equiaxed crystals; (2) if granular equiaxed crystals move at the end of solidification, a segregation portion also moves along with the granular equiaxed crystals, and segregating elements are easy to gather at a portion surrounded by a plurality of gathering granular equiaxed crystals, which makes segregation easy to be large; and (3) porosity is easy to form at a portion surrounded by segregation that forms around granular equiaxed crystals. Therefore, so far, porosity and segregation have been tried to be remedied by making columnar crystals with which both porosity and segregation are easier to be reduced at the same time than with granular equiaxed crystals, easy to grow.

In a case where the central porosity volume is reduced by heavily rolling a cast slab in the later process, conventionally, it is necessary to carry out heavy rolling of no less than 0.7 in shape factor $\gamma$ in the later process in order to reduce central porosity of a conventional cast slab of 230 to 380 mm in thickness (casting thickness) D to a level with passing ultrasonic testing at the stage of a thick steel plate. To carry out such rolling, the cast slab has to be heated at a high temperature to 1250° C. or more, which requires a high cost. The shape factor $\gamma$ is an indicator used for showing a degree of rolling, and a value thereof is defined by the formula: contact arc length of a reduction roll with a steel plate/mean plate thickness$=(R(h_0-h_1))^{0.5}/(0.5(h_0+h_1))$, where R is a roll diameter (mm), $h_0$ is entry side plate thickness (mm) and $h_1$ is delivery side plate thickness (mm).

In order to reduce the amount of forming central porosity at the casting stage, for example, Patent Literature 1 discloses the art that after perfect solidification of a slab when the surface temperature of the slab is 700 to 1000° C., the slab is sandwiched between upper and lower rolls each having a projecting portion at the center and is subjected to rolling reduction to be crushed, to reduce central porosity.

Patent Literature 2 discloses the art that before completing the solidification after bulging the cast slab into 10 mm or more, the center part of the width is subjected to reduction, and successively, the vicinity of either edge part is subjected to reduction, so that the solidified interfaces are press-stuck.

Patent Literature 3 discloses the art that the center part in the thickness of the cast slab is subjected to reduction in the continuous casting equipment in the condition of 1400° C. to the solidified temperature thereat.

CITATION LIST

Patent Literature

Patent Literature 1: JP2009-279652A
Patent Literature 2: JP2001-334353A
Patent Literature 3: JP H07-227658A

SUMMARY OF INVENTION

Technical Problem

An object of the art disclosed in Patent Literature 1 is so-called a bloom that is cast to be narrow, and whose ratio (D/W) of the casting thickness (thickness) D to the casting width W is 0.7. If this art is applied to a wide slab whose ratio (D/W) of the casting thickness D to the casting width W is 0.1 to 0.3, applied loads to the upper and lower rolls are very large, and therefore, the durability of the rolls is insufficient and the productivity deteriorates, which is problematic.

While the art disclosed in Patent Literature 2 is effective if the last unsolidified part forms near edge parts of the cast slab width, it is not effective if the last unsolidified part forms at the center part of the cast slab width, which is problematic.

The art disclosed in Patent Literature 3 is not effective if the last unsolidified part forms near edge parts of the cast slab width, which is problematic.

As described above, the art of reducing the central porosity volume of a slab having a large casting thickness D at the continuous casting stage is not established. The art of reducing segregation generated around central porosity at the continuous casting stage is not established as well. Thus, it is the actual circumstance that heavy rolling is carried out in the later process, to reduce central porosity to a level with passing ultrasonic testing specified in Japanese Industrial Standards (JIS) G 0801:2008 shown in Table 3, which is done at the stage of a thick steel plate. However, in heavy rolling in the later process, although the central porosity volume can be reduced, it is difficult to reduce segregation.

An object of the present invention is to solve the problems the above described prior arts have, and to provide a continuous-cast slab where central porosity is surely reduced, and also, segregation is reduced during casting by crushing the slab, and a method and apparatus of manufacturing the same. It is also an object of the present invention to solve the above described conventional problems, and to provide a method of manufacturing a thick steel plate that passes ultrasonic testing, where central porosity and segregation are reduced at the continuous casting stage without heavy rolling of no less than 0.7 in shape factor γ at low cost.

Solution to Problem

The inventors of the present invention found that: it is possible to check movement of granular equiaxed crystals at the end of solidification by forming the granular equiaxed crystals so that crystals in the upper surface side of a cast slab and those in the lower surface side are symmetrical (hereinafter referred to as "horizontally symmetrical" or "uniform") with respect to the thickness center of the cast slab; and as a result, it is possible to reduce central porosity and segregation. Here, "horizontally symmetrical" means that difference between the equiaxed crystal ratios of the upper half and the lower half of the cast slab bordered by the thickness center of the cast slab is no more than 5%. "Equiaxed crystal ratio" means the ratio of thickness of a zone where equiaxed crystals form in the upper half of the cast slab in the thickness direction, to the ½ cast slab thickness. The inventors further found that it is possible to reduce central porosity more than conventional arts by carrying out proper reduction at the continuous casting stage. The present invention was completed based on these findings.

The present invention made for solving the above problems will be described. In the following description, the fraction solid X1 to X2 represents the fraction solid within the range of no less than X1 and no more than X2 unless otherwise mentioned. In addition, Y1 to Y2 that refers to another except the fraction solid (for example, the ratio D/W, casting thickness, the dent amount, the dent rate, distance, the maximum shape factor, steel plate thickness, the ratio $d_1/D$, the ratio $d_2/D$, casting width and heating temperature) represents a value within the range of no less than Y1 and no more than Y2 unless otherwise mentioned.

A first aspect of the present invention is a continuous-cast slab of 0.1 to 0.3 in ratio D/W, the ratio D/W being a ratio of casting thickness D to casting width W, and 230 to 380 mm in casting thickness D, the continuous-cast slab having a horizontally symmetrical granular equiaxed crystals at least in a center in a thickness direction, the continuous-cast slab comprising: a first reduction dent and a second reduction dent that is narrower than the first reduction dent at least on one long side surface, the second reduction dent denting further from a bottom surface of the first reduction dent, wherein a dent amount $d_1$ of the first reduction dent from an end surface of the continuous-cast slab is 0.08 to 1.1 mm, and a dent amount $d_2$ of the second reduction dent from the bottom surface of the first reduction dent is 1.2 to 12 mm.

A second aspect of the present invention is a continuous-east slab of 0.1 to 0.3 in ratio D/W, the ratio D/W being a ratio of casting thickness D to casting width W, and 230 to 380 mm in casting thickness D, the continuous-cast slab having a horizontally symmetrical granular equiaxed crystals at least in a center in a thickness direction, the continuous-cast slab comprising: a first reduction dent and a second reduction dent that is narrower than the first reduction dent at least on one long side surface, the second reduction dent denting further from a bottom surface of the first reduction dent, wherein a dent rate of the first reduction dent from an end surface of the continuous-cast slab, to the casting thickness D is 0.03 to 0.36%, and a dent rate of the second reduction dent from the bottom surface of the first reduction dent, to the casting thickness D is 0.6 to 4%.

In the present invention, "dent rate" means the reduction rate at a dent on the basis of the thickness before the dent is formed. That is, "a dent rate of the first reduction dent from an end surface of the continuous-cast slab, to the casting thickness D" represents "the amount of denting the first reduction dent $d_1$/casting thickness D×100(%)". "A dent rate of the second reduction dent from the bottom surface of the first reduction dent, to the casting thickness D" represents "the amount of denting the second reduction dent $d_2$/casting thickness D×100(%)".

In the first aspect of the present invention, preferably, a dent rate of the first reduction dent from the end surface of the continuous-cast slab, to the casting thickness D is 0.03 to 0.36%, and a dent rate of the second reduction dent from the bottom surface of the first reduction dent, to the casting thickness D is 0.6 to 4%.

In the first and second aspects of the present invention, preferably, distance between either end of the first reduction dent and the end surface of the continuous-cast slab is 0.37×the casting thickness D to 1.0×the casting thickness D, and distance between either end of the second reduction dent and the end surface of the continuous-cast slab is 0.5×the casting thickness D to 1.2×the casting thickness D.

In the first and second aspects of the present invention, preferably, a maximum porosity volume is no more than $1.5\times10^{-4}$ $cm^3/g$.

A third aspect of the present invention is a method of manufacturing a continuous-cast slab, the method comprising: a first step of forming a first reduction dent at least in one long side surface of the continuous-cast slab by carrying out reduction with first reduction rolls on the continuous-cast slab, the continuous-cast slab being 0.1 to 0.3 in ratio D/W, the ratio D/W being a ratio of casting thickness D to casting width W, and 230 to 380 mm in casting thickness D, the continuous-cast slab having a horizontally symmetrical granular equiaxed crystals at least in a center in a thickness direction; and a second step of forming a second reduction dent that is narrower than the first reduction dent by carrying out further reduction on a bottom surface of the first reduction dent with second reduction rolls that are narrower than the first reduction rolls, wherein in the first step, the reduction is carried out on the continuous-cast slab so that a dent amount $d_1$ of the first reduction dent from an end surface of the continuous-cast slab is 0.08 to 1.1 mm, and in the second step, the reduction is carried out on the continuous-cast slab so that a dent amount $d_2$ of the second reduction dent from the bottom surface of the first reduction dent is 1.2 to 12 mm.

A fourth aspect of the present invention is a method of manufacturing a continuous-cast slab, the method comprising: a first step of forming a first reduction dent at least in one long side surface of the continuous-cast slab by carrying out reduction with first reduction rolls on the continuous-cast slab, the continuous-cast slab being 0.1 to 0.3 in ratio D/W, the ratio D/W being a ratio of casting thickness D to casting width W, and 230 to 380 mm in casting thickness D, the continuous-cast slab having a horizontally symmetrical granular equiaxed crystals at least in a center in a thickness direction; and a second step of forming a second reduction dent that is narrower than the first reduction dent by carrying out further reduction on a bottom surface of the first reduction dent with second reduction rolls that are narrower than the first reduction rolls, wherein in the first step, the reduction is carried out on the continuous-cast slab so that a dent rate of the first reduction dent from an end surface of the continuous-cast slab, to the casting thickness D is 0.03 to 0.36%, and in the second step, the reduction is carried out on the continuous-cast slab so that a dent rate of the second reduction dent from the bottom surface of the first reduction dent, to the casting thickness D is 0.6 to 4%.

In the third aspect of the present invention, preferably, in the first step, the reduction is carried out on the continuous-cast slab so that a dent rate of the first reduction dent from the end surface of the continuous-cast slab, to the casting thickness D is 0.03 to 0.36%, and in the second step, the reduction is carried out on the continuous-cast slab so that a dent rate of the second reduction dent from the bottom surface of the first reduction dent, to the casting thickness D is 0.6 to 4%.

In the third and fourth aspects of the present invention, preferably, the first reduction rolls are provided for a zone where a fraction solid is 0.3 to 0.7, and the second reduction rolls are provided for a zone where a fraction solid is 0.7 to 1.0, downstream from the first reduction rolls.

Here, the fraction solid can be obtained by, for example, heat transfer calculation, a change in transmissivity of a horizontal electromagnetic acoustic wave.

In the third and fourth aspects of the present invention, preferably, distance between either end of the first reduction dent and an end surface of the continuous-cast slab is 0.37×the casting thickness D to 1.0×the casting thickness D, and distance between either end of the second reduction dent and the end surface of the continuous-cast slab is 0.5×the casting thickness D to 1.2×the casting thickness D.

In the third and fourth aspects of the present invention, preferably, a maximum porosity volume of the continuous-cast slab manufactured through the first and second steps is no more than $1.5\times10^{-4}$ $cm^3/g$.

A fifth aspect of the present invention is an apparatus of manufacturing a continuous-cast slab, the apparatus comprising: first reduction rolls that shape an intermediate shaped product having a first reduction dent at least on one long side surface of the continuous-cast slab, the continuous-cast slab being 0.1 to 0.3 in ratio D/W, the ratio D/W being a ratio of casting thickness D to casting width W, the continuous-cast slab being 230 to 380 mm in casting thickness D, and having horizontally symmetrical granular equiaxed crystals at least in a center in a thickness direction; and second reduction rolls that shape a second reduction dent denting further from a bottom surface of the first reduction dent of the intermediate shaped product and being narrower than the first reduction dent, the second reduction rolls having shapes narrower than the first reduction rolls and being arranged downstream from the first reduction rolls, wherein the first reduction rolls are provided so that a dent amount $d_1$ of the first reduction dent from an end surface of the continuous-cast slab is 0.08 to 1.1 mm, and the second reduction rolls are provided so that a dent amount $d_2$ of the second reduction dent from the bottom surface of the first reduction dent is 1.2 to 12 mm.

A sixth aspect of the present invention is an apparatus of manufacturing a continuous-cast slab, the apparatus comprising: first reduction rolls that shape an intermediate shaped product having a first reduction dent at least on one long side surface of the continuous-cast slab, the continuous-cast slab being 0.1 to 0.3 in ratio D/W, the ratio D/W being a ratio of casting thickness D to casting width W, the continuous-cast slab being 230 to 380 mm in casting thickness D, and having horizontally symmetrical granular equiaxed crystals at least in a center in a thickness direction; and second reduction rolls that shape a second reduction dent denting further from a bottom surface of the first reduction dent of the intermediate shaped product and being narrower than the first reduction dent, the second reduction rolls having shapes narrower than the first reduction rolls and being arranged downstream from the first reduction rolls, wherein the first reduction rolls are provided so that a dent rate of the first reduction dent from an end surface of the continuous-cast slab, to the casting thickness D is 0.03 to 0.36%, and the second reduction rolls are provided so that a dent rate of the second reduction dent from the bottom surface of the first reduction dent, to the casting thickness D is 0.6 to 4%.

In the fifth aspect of the present invention, preferably, the first reduction rolls are provided so that a dent rate of the first reduction dent from an end surface of the continuous-cast slab, to the casting thickness D is 0.03 to 0.36%, and the second reduction rolls are provided so that a dent rate of the second reduction dent from the bottom surface of the first reduction dent, to the casting thickness D is 0.6 to 4%.

In the fifth and sixth aspects of the present invention, preferably, the first reduction rolls are provided for a zone where a fraction solid is 0.3 to 0.7, and the second reduction rolls are provided for a zone where a fraction solid is 0.7 to 1.0, downstream from the first reduction rolls.

In the fifth and sixth aspects of the present invention, preferably, the first reduction rolls are provided so that distance between either end of the first reduction dent and the end surface of the continuous-cast slab is 0.37×the casting thickness D to 1.0×the casting thickness D, and the second reduction rolls are provided so that distance between either end of the second reduction dent and the end surface of the continuous-cast slab is 0.5×the casting thickness D to 1.2×the casting thickness D.

In the fifth and sixth aspects of the present invention, preferably, a maximum porosity volume of the continuous-cast slab is no more than $1.5\times10^{4}$ $cm^3/g$.

A seventh aspect of the present invention is a method of manufacturing a thick steel plate comprising: a continuous-cast slab manufacturing step of manufacturing a continuous-cast slab according to the method of manufacturing a continuous-cast slab of the above described third or fourth aspect of the present invention; and a rolling step of rolling, within the range of 0.2 to 0.65 in maximum shape factor, the continuous-cast slab manufactured in the continuous-cast slab manufacturing step, the continuous-cast slab being no more than $2.5\times10^{4}$ $cm^3/g$ in maximum porosity volume.

Here, "maximum shape factor" means the maximum shape factor in one pass in a case where hot-rolling is carried out on a thick steel plate with multi passes.

In the seventh aspect of the present invention, preferably, steel plate thickness to casting thickness D after the rolling step is ended is 50% to 80% by the rolling step.

In the seventh aspect of the present invention, preferably, the steel plate thickness after the rolling step is ended is 150 to 300 mm by the rolling step.

The steel plate manufactured according to the method of manufacturing a thick steel plate of the seventh aspect of the present invention can be manufactured by an apparatus of manufacturing a thick steel plate of the present invention, described later.

An eighth aspect of the present invention is an apparatus of manufacturing a thick steel plate, the apparatus comprising: the apparatus of manufacturing a continuous-cast slab according to the above described fifth or sixth aspect of the present invention; and a rolling mill that rolls the continuous-cast slab manufactured by the apparatus of manufacturing a continuous-cast slab, wherein the rolling mill rolls, within the range of 0.2 to 0.65 in maximum shape factor, the continuous-cast slab of no more than $2.5\times10^{-4}$ $cm^3/g$ in maximum porosity volume.

In the eighth aspect of the present invention, preferably, the rolling mill makes steel plate thickness after said rolling 50% to 80% to casting thickness D.

In the eighth aspect of the present invention, preferably, the rolling mill makes steel plate thickness after said rolling 150 to 300 mm.

Advantageous Effects of Invention

According to the continuous-cast slab of the present invention and the method and apparatus of manufacturing the same, it is possible to provide the continuous-cast slab where maximum porosity volume and segregation are reduced to a low level even if the slab is so wide as to be 0.1 to 0.3 in ratio D/W of the casting thickness D to the casting width W and 230 to 380 mm in casting thickness D.

According to the apparatus and method of manufacturing the continuous-cast slab of the present invention, two stages of reduction are carried out, which brings about an effect of not applying an excessive load to a reduction roll.

According to the method and apparatus of manufacturing a thick steel plate of the present invention, a continuous-cast slab where maximum porosity volume (the maximum central porosity volume) is reduced in a cast slab manufacturing step can be obtained. Thus, in a rolling step following the cast slab manufacturing step, the steel plate where internal flaws caused by central porosity are reduced to a level with passing ultrasonic testing can be manufactured even under a condition of 0.2 to 0.65 in maximum shape factor. In this case, it is not necessary to heat the cast slab at a high temperature as conventional prior arts. Thus, the manufacturing costs of the thick steel plate can be greatly reduced.

DESCRIPTION OF EMBODIMENTS

The present invention will be described with reference to the accompanying drawings properly. The embodiments below are examples of the present invention, and the present invention is not limited thereto.

1. Continuous-Cast Slab 1 of Present Invention

Figure 1:
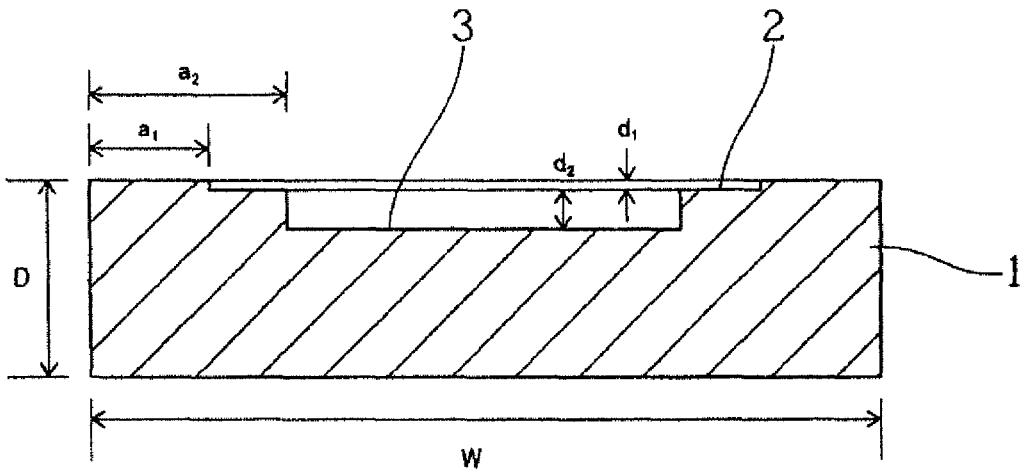
FIG. 1 is a schematic view showing a cross-sectional shape of the continuous-cast slab of the present invention.

FIG. 1 is a schematic view showing a cross-sectional shape of the continuous-cast slab of the present invention. In FIG. 1, dents (first reduction dent 2 and second reduction dent 3) are exaggeratedly illustrated.

The continuous-cast slab 1 of the present invention is a cast slab that: the ratio D/W of the casting thickness D to the casting width W is 0.1 to 0.3; the casting thickness D is 230 to 380 mm; and horizontally symmetrical granular equiaxed crystals are included at least at the center in the thickness direction which solidification from ends does not affect when the thickness direction is regarded as a vertical axis and the width direction of long sides is regarded as a horizontal axis. As shown in FIG. 1, the continuous-cast slab 1 has the first reduction dent 2 and the second reduction dent 3 that dents further from the bottom surface of the first reduction dent 2 and that is narrower than the first reduction dent 2, at least in one surface. Where solidification from ends does not affect as described above is a zone except a portion of columnar crystals, which solidifies from ends. This zone almost corresponds to the rest of a long side which is obtained by deducting the casting thickness D from each end of the long side.

A cast slab having a cross-sectional shape like the cast slab of 0.1 to 0.3 in ratio D/W of the casting thickness D to the casting width W and 230 to 380 mm in casting thickness D is called a slab. The lower limit of the ratio D/W is 0.1 because the casting width W is approximately 2500 mm or more under a condition that the casting thickness D is 230 to 380 mm, which makes it difficult to carry out reduction on the wide cast slab uniformly in the width direction. The upper limit thereof is 0.3 because solidification from the end has great influence and thus sufficient reduction cannot be carried out due to restrictions on equipment. In the present invention, the maximum value of the casting width W is not especially limited. The casting width W is preferably 1320 to 2360 mm.

If the casting thickness D is over 380 mm, reaction force to reduction rolls is strengthened, which makes the rolls easy to deform. Therefore, it is necessary to make the reduction rolls and a segment that supports the reduction rolls highly rigid, and the cost of equipment goes up, which is not preferable. If the casting thickness D is less than 230 mm, the casting speed has to be slowed down, and the productivity also deteriorates, which is not preferable. In such a view, the casting thickness D is 230 to 380 mm.

The continuous-east slab 1 has horizontally symmetrical granular equiaxed crystals at least in the center in the thickness direction which solidification from the ends does not affect when the thickness direction is regarded as a vertical axis and the width direction of long sides is regarded as a horizontal axis. Such a configuration makes it possible to uniformly transmit force from the upper and lower sides of the cast slab to the center thereof in the thickness direction upon reduction for forming the first reduction dent 2 and the second reduction dent 3. As a result, sheering force that has potential for driving force of moving granular equiaxed crystals can be checked, and thus, the movement of granular equiaxed crystals can be checked. Checking the movement of granular equiaxed crystals makes it possible to check the movement of segregation elements, and thus, segregation can be checked. In addition, checking the movement of granular equiaxed crystals makes a size of a zone sandwiched between (surrounded by) a plurality of granular equiaxed crystals small, and thus, the porosity (central porosity) volume forming in the zone can be reduced.

Further, a diameter of each granular equiaxed crystal is made to be small, which makes the resistance against movement of granular equiaxed crystals increase when sheering stress operates, and which makes the zone surrounded by granular equiaxed crystals smaller. The size of a granular equiaxed crystal is no more than 1.5 mm, and preferably no more than 1.3 mm in equivalent circle diameter.

According to the present invention, as described above, the continuous-cast slab where the central porosity volume is reduced and segregation is held down during casting can be made even if the cast slab is wide.

Reduction corresponding to solidification shrinkage is carried out on the continuous-cast slab of the present invention by forming the wide first reduction dent 2 in continuous-casting equipment, to prevent molten steel flow from occurring. Whereby, it is possible to make the initial diameter of porosity small. Next, reduction is further carried out on the bottom surface of the first reduction dent 2, to form the second reduction dent 3 narrower than the first reduction dent 2. Whereby, contact-bonding can be subjected to forming porosity by reduction. Such two-stage reduction makes it possible to reduce the maximum porosity volume of the slab to a low level without applying an excessive load to reduction rolls.

Figure 2:
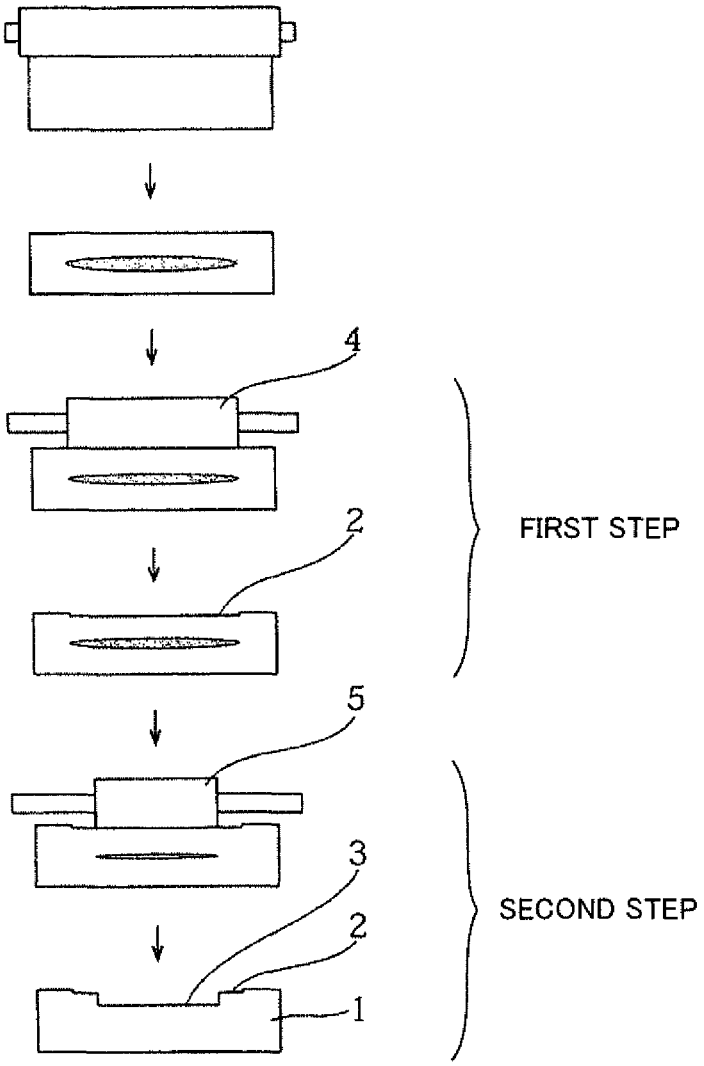
FIG. 2 is an explanatory view showing an example of steps included in the method of manufacturing the continuous-cast slab of the present invention.

It is general in continuous casting equipment that one surface of a cast slab that hangs down from a mold is defined as a reference plane, and support rolls are arranged so that the other surface corresponds to solidification shrinkage to incline. FIG. 2 illustrates an embodiment of steps included in the method of manufacturing the continuous-cast slab of the present invention. Because a first reduction roll 4 and a second reduction roll 5 are arranged in the opposite side to the reference plane in this embodiment, FIG. 1 shows the continuous-cast slab 1, only one surface of which the wide first reduction dent 2 and the narrow second reduction dent 3 are formed on. The present invention is not limited to this embodiment, and the first reduction dent 2 and the second reduction dent 3, which is narrower than the first reduction dent 2, may be formed on both surfaces of the continuous-cast slab.

In the present invention, the dent amount $d_1$ of the first reduction dent 2 from each end surface of the continuous-cast slab 1 is 0.08 to 1.1 mm. The lower limit of the dent amount $d_1$ is 0.08 mm in order to reduce formation of porosity due to the volume shrinkage. The upper limit thereof is 1.1 mm in order to reduce center segregation and formation of porosity due to the movement of equiaxed crystals. In the present invention, the dent amount $d_2$ of the second reduction dent 3 from the bottom surface of the first reduction dent 2 is 1.2 to 12 mm. The lower limit of the dent amount $d_2$ is 1.2 mm in order to obtain an effect of reducing central porosity. The upper limit thereof is 12 mm in order to check occurrence of surface cracking.

In the present invention, the dent rate can be specified instead of, or in addition to the dent amount. The dent rate of the first reduction dent 2 from each end surface of the cast slab, to the casting thickness D is 0.03 to 0.36%. That is, the ratio $d_1/D$ of the dent amount $d_1$ of the first reduction dent 2 from each end surface of the cast slab, to the casting thickness D is specified as $d_1/D$=0.03 to 0.36%. The lower limit of the dent rate is 0.03% in order to reduce formation of porosity due to the volume shrinkage. The upper limit thereof is 0.36% in order to reduce center segregation and formation of porosity due to the movement of equiaxed crystals. The dent rate of the second reduction dent 3 from the bottom surface of the first reduction dent 2, to the casting thickness D is 0.6 to 4%. That is, the ratio $d_2/D$ of the dent amount $d_2$ of the second reduction dent from the bottom surface of the first reduction dent, to the casting thickness D is specified as $d_2/D$=0.6 to 4%. If the dent rate of the second reduction dent from the bottom surface of the first reduction dent, to the casting thickness D is less than 0.6%, the effect of reducing central porosity is insufficient, which is not preferable. If the dent rate thereof is over 4%, the possibility of surface cracking becomes high, which is not preferable. Therefore, the dent rate of the second reduction dent 3 from the bottom surface of the first reduction dent 2, to the casting thickness D is specified as 0.6 to 4%.

Specifying the dent rate and the dent amount of the first reduction dent, and those of the second reduction dent within the above described ranges makes it possible to reduce the maximum porosity volume of the slab to a low level with $1.5\times10^{-4}$ $cm^3/g$ or less.

Preferably, the first reduction dent 2 exists at a position so that distance of between an end of the first reduction dent 2 and a corresponding end surface of the cast slab is 0.37×the casting thickness D to 1.0×the casting thickness D. The lower limit of the distance $a_1$ is preferably 0.37×the casting thickness D in order to make the influence of each end of the cast slab, which have a high strength, small, to obtain a high reduction efficiency. The upper limit of the distance $a_1$ is preferably 1.0×the casting thickness D in order to make the length in the vicinity of the ends of the cast slab, on which rolling with rolls is not carried out, short. Preferably, the second reduction dent 3 exists at a position so that distance $a_2$ between an end of the second reduction dent 3 and a corresponding end surface of the cast slab is 0.5×the casting thickness D to 1.2×the casting thickness D. The lower limit of the distance $a_2$ is preferably 0.5×the casting thickness D in order to make the influence of each end of the cast slab, which have a high strength, small, to obtain a high reduction efficiency. The upper limit of the distance $a_2$ is preferably 1.2×the casting thickness D in order to make the length in the vicinity of the ends of the cast slab, on which rolling with rolls is not carried out, short.

It is assumed that reduction at the first stage is carried out just before a position of the fraction solid of the liquid limit of molten steel in the cast slab flowing out of the mold can make the initial diameter of central porosity small. Here, solidification shrinkage occurs almost all over the cast slab except both ends of the casting width. Thus, it is necessary in the present invention that the first reduction dent 2 is wide.

On the other hand, at the stage after the first reduction dent 2 is formed, the zone where central porosity forms shrinks around the center of the casting width. Therefore, preferably, the second reduction dent 3 is narrower than the first reduction dent 2, to have an aspect of applying more concentrative reduction.

Both ends of the casting width W are excluded as described above because solidification progresses from the ends of the cast slab as well. A roll having the length same as or more than the casting width W is easy to deform due to reaction force of reduction. Therefore, in the present invention, preferably, the reduction rolls have narrower reduction width than the reduction casting width.

Preferably, the maximum porosity volume of the continuous-cast slab 1 of the present invention is no more than $1.5\times10^{-4}$ $cm^3/g$.

The central porosity volume of a conventional material is about 6 to $10\times10^{-4}$ $cm^3/g$. If such a volume of central porosity remains inside the cast slab, internal flaws occur in an end product, which results in a critical problem with which destruction is started off, unless rolling with a high shape factor such as no less than 0.7 in maximum shape factor in heavy plate rolling is carried out. Preferably, the remaining amount of central porosity in the continuous-cast slab of the present invention is low, that is, the maximum porosity volume of the slab is no more than $1.5\times10^{-4}$ $cm^3/g$. The central porosity volume of no more than $1.5\times10^{-4}$ $cm^3/g$ makes it possible to obtain effects of reducing the shape factor in heavy plate rolling and of reducing internal flaws in products with the low shape factor.

The central porosity volume Pv can be obtained by: $Pv=(1/\rho)-(1/\rho_0)$ ($cm^3/g$) where the density of a representative sample of a ¼ thickness portion of the same kind of a cast slab is $\rho_0$ and the density of a sample of the center part is $\rho$.

Preferably, a size of the representative sample is 50 mm in length, 100 mm in width and 7 mm in thickness. As the precision of surface finishing of the sample, a smooth finishing surface is preferable. Conforming to JIS B 0601: 2013, preferably, the surface roughness is no more than 1.6 (μm) in arithmetic average roughness Ra, and more preferably no more than 0.8 (μm) therein. If the surface is rough, there is a case that when the sample is immersed in water, bubbles are trapped on the surface, and the accuracy of Pv is not high, which is not preferable. In the present invention, all the center of the cast slab thickness in the cast slab width direction, excluding portions within D/2 from short sides of the cast slab is cut out as surfaces in length and width of the sample, and the maximum value of the porosity volume in the width direction is defined as the maximum central porosity volume. The density $\rho_0$ of the ¼ thickness portion can be the mean value of the porosity volumes of the samples cut out from six points in the width direction.

The center of the continuous-cast slab 1 of the present invention, which is at a high temperature, deforms first. Thus, dendrite structure forming in the top layer of the cast slab upon solidification is linear. However, if reduction is carried out after completion of solidification, the top layer also deforms, and dendrite structure curves. Thus, the continuous-cast slab 1 is distinguishable from a conventional product on which reduction is carried out after the completion of solidification.

2. Apparatus of Manufacturing Continuous-Cast Slab 1 According to Present Invention Continuous casting equipment that is the apparatus of manufacturing the continuous-cast slab 1 according to the present invention includes the first reduction rolls 4 and the second reduction rolls 5 that are narrower than the first reduction rolls 4.

Figure 5:
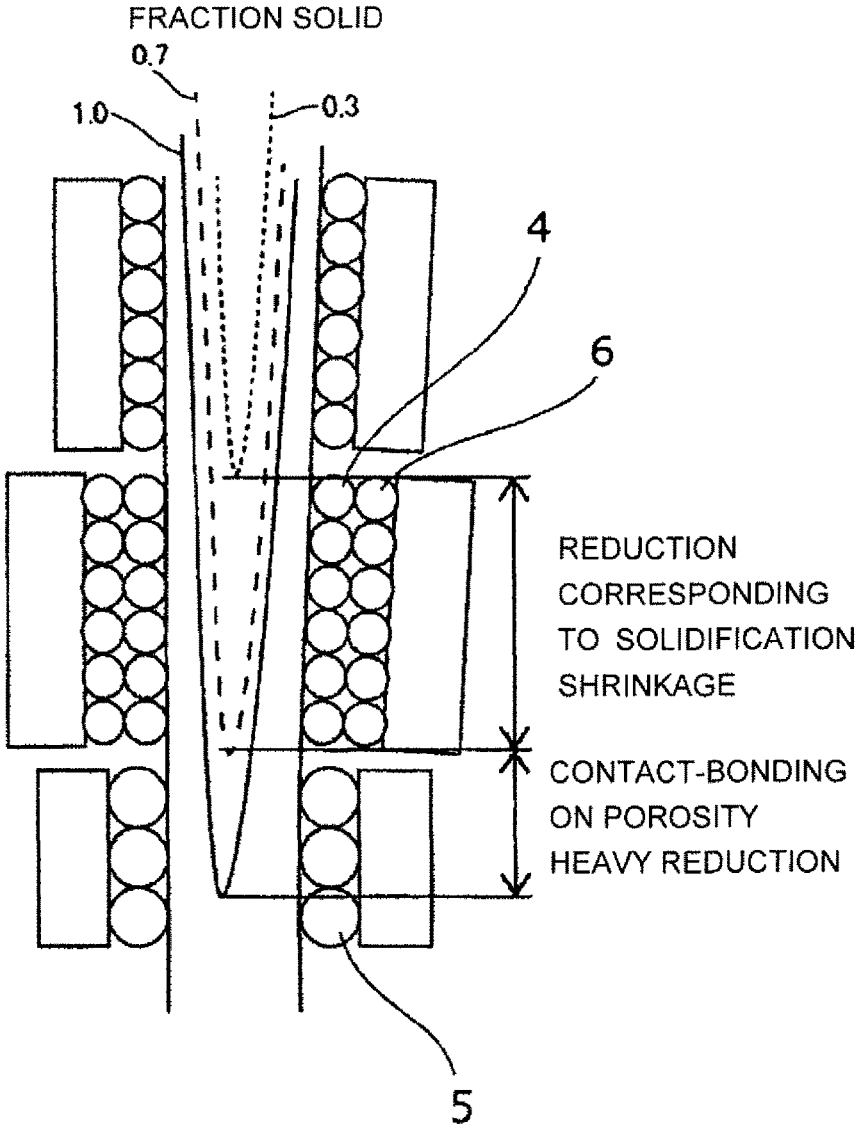
FIG. 5 is an explanatory view schematically showing an example of part of the apparatus of manufacturing the continuous-cast slab of the present invention.

FIG. 5 is an explanatory view schematically showing an example of part of the apparatus of manufacturing the continuous-cast slab according to the present invention. In FIG. 5, the first reduction rolls 4 and the second reduction rolls 5 are arranged beneath the mold of the continuous casting equipment. FIG. 5 shows an aspect that reduction is carried out on the cast slab in the thickness direction in the vicinity of the solidification end point. While FIG. 5 illustrates the first reduction rolls 4 consisting of rolls of six stages which include backup rolls 6, and the second reduction rolls 5 consisting of rolls of three stages, the apparatus of manufacturing the continuous-cast slab 1 according to the present invention is not limited to this aspect.

FIG. 2 is an explanatory view showing an example of steps included in the method of manufacturing the continuous-cast slab according to the present invention.

As shown in FIG. 2, the first reduction dent 2 is formed by pressing the surface of the cast slab with the first reduction rolls 4 equipped with the continuous casting equipment. The second reduction dent 3 is formed by pressing the bottom surface of the first reduction dent 2 with the second reduction rolls 5 disposed beneath (at the later stage of) the first reduction rolls 4.

(1) Continuous Casting Equipment

A type of the continuous casting equipment of manufacturing the continuous-cast slab 1 according to the present invention is not especially limited. The present invention can be applied to any of a vertical bending-type, a bending-type and a vertical type. A vertical type is preferable in view of achieving an aspect of easily manufacturing the continuous-cast slab 1 having horizontally symmetrical granular equiaxed crystals in the center in the thickness direction. In the case of either vertical bending-type or bending-type, for example, the continuous-cast slab 1 having horizontally symmetrical granular equiaxed crystals can be manufactured through electromagnetic stirring or the like. Electromagnetic stirring is applicable to a vertical type as well. Application of electromagnetic stirring to a vertical type makes it easier to manufacture the continuous-cast slab 1 having horizontally symmetrical granular equiaxed crystals in the center in the thickness direction.

Further, it is also effective for adjustment of equiaxed crystals thickness to adjust the strength of electromagnetic stirring on the upper and lower surfaces while adjusting the degree of superheat of molten steel (difference between temperature of molten steel in the cast slab and solidification start temperature during casting), and to adjust the strength of multi-stage electromagnetic stirring on the upper and lower surfaces.

(2) First Reduction Rolls 4

The first reduction rolls 4 shape the first reduction dent at least on one long side surface of the cast slab by carrying out reduction on the cast slab.

Preferably, the first reduction rolls 4 are disposed just before a position of the fraction solid of the flow limit of molten steel in the cast slab flowing out of the mold. Reduction corresponding to solidification shrinkage, that is, reduction (light reduction) so as to lessen the thickness of the cast slab as much as solidification shrinkage that causes formation of porosity is carried out, to prevent molten steel flow from occurring. Specifically, the fraction solid of the cast slab just before the above described position is about 0.3 to 0.7. If reduction with the first reduction rolls 4 is carried out at a position where the fraction solid of the cast slab is less than 0.3, because the fraction solid of less than 0.3 brings about the same behavior as absolute liquid, liquid is just pushed out upstream in the casting direction, and there is no influence on center segregation and porosity. If reduction with the first reduction rolls 4 is carried out at a position where the fraction solid of the cast slab is over 0.7, deformation resistance suddenly increases, which makes it difficult to carry out reduction due to restriction on the equipment. Thus, preferably, reduction with the first reduction rolls 4 is carried out at a position where the fraction solid of the cast slab is 0.3 to 0.7 in order to avoid such a situation. It is presumed that reduction at the first stage at this position can make the initial diameter of central porosity small.

Solidification shrinkage occurs almost all over the cast slab except both ends of the casting width. Thus, it is necessary that the first reduction dent 2, which is formed by reduction with the first reduction rolls 4, is wide. Preferably, the distance $a_1$ between an end of the first reduction dent 2 and a corresponding end surface of the cast slab is 0.37×the casting thickness D to 1.0×the casting thickness D. Here, both ends of the casting width W are excluded because solidification also progresses from the ends of the cast slab. A normal roll that has the length same as or more than the casting width W is easy to deform due to reaction force of reduction. Thus, it is necessary that the first reduction rolls 4 are rolls having reduction width shorter than the reduction casting width.

Reduction with the first reduction rolls 4 is carried out on the cast slab of 0.1 to 0.3 in ratio D/W of the casting thickness D to the casting width W, 230 to 380 mm in casting thickness D, which has horizontally symmetrical granular equiaxed crystals at least in the center in the thickness direction, so that the dent amount $d_1$ of the first reduction dent 2 from each end surface of the cast slab is 0.08 to 1.1 mm. This reduction is also carried out so that the dent rate of the first reduction dent from an end surface of the cast slab, to the casting thickness D is 0.03 to 0.36%.

(3) Second Reduction Rolls 5

The second reduction rolls 5 have shapes narrower than the first reduction rolls 4. The second reduction rolls 5 shape the second reduction dent 3 narrower than the first reduction dent 2 by carrying out further reduction on the bottom surface of the first reduction dent 2 of an intermediate shaped product.

Preferably, the second reduction rolls 5 are arranged in the downstream side of the first reduction rolls 4 between the position of the fraction solid of the flow limit of molten steel in the cast slab flowing out of the mold and the complete solidification point. Contact-bonding is carried out on porosity forming in the cast slab by reduction with the second reduction rolls 5, which makes central porosity reduced. Specifically, the fraction solid of the cast slab between the position of the fraction solid of the flow limit of molten steel in the cast slab flowing out of the mold and the complete solidification place is approximately 0.7 to 1.0. If reduction with the second reduction rolls 5 is carried out at the position where the fraction solid of the cast slab is less than 0.7, equiaxed crystals greatly move. Thus, center segregation and porosity deteriorate. Therefore, preferably, reduction with the second reduction rolls 5 is carried out at the position where the fraction solid of the cast slab is 0.7 to 1.0 in order to avoid such a situation. Central porosity can be subjected to contact-bonding, to be reduced by reduction at the second stage with the second reduction rolls 5 at this position.

When the fraction solid of the cast slab is 0.7 to 1.0, a zone where central porosity forms shrinks around the center of the casting width. Thus, the second reduction dent 3 is shaped so as to be narrower than the first reduction dent 2 by applying more concentrative reduction. Whereby, contact-bonding can be subjected to central porosity firmly. Preferably, the distance $a_2$ between an end of the second reduction dent 3 (that is, an end of each second reduction roll 5) and a corresponding end surface of the cast slab is 0.5×the casting thickness D to 1.2×the casting thickness D.

Reduction with the second reduction rolls 5 is carried out on the east slab of 0.1 to 0.3 in ratio D/W of the casting thickness D to the casting width W, 230 to 380 mm in casting thickness D, which has horizontally symmetrical granular equiaxed crystals at least in the center in the thickness direction, so that the dent amount $d_2$ of the second reduction dent 3 from the bottom surface of the first reduction dent 2 is 1.2 to 12 mm. This reduction is also carried out so that the dent rate of the second reduction dent 3 from the bottom surface of the first reduction dent 2, to the casting thickness D is 0.6 to 4%.

Specifying the dent rate and dent amount of the first reduction dent 2, and those of the second reduction dent 3 within the above described ranges makes it possible to reduce the maximum porosity volume of the slab to a low level with no more than $1.5\times10^{-4}$ $cm^3/g$.

It is general in continuous casting equipment that one surface of a cast slab that hangs down from a mold is defined as a reference plane, and support rolls are arranged so that the other surface corresponds to solidification shrinkage to incline. Here, in the embodiment shown in FIG. 5, the first reduction rolls 4 and the second reduction rolls 5 are arranged in the opposite side to the reference plane. Therefore, in FIG. 1, the first reduction dent 2 and the second reduction dent 3 that is narrower than the first reduction dent 2 are formed only on one surface of the continuous-cast slab 1. In short, the embodiment shown has an aspect of arranging the first reduction rolls 4 and the second reduction rolls 5 only on one surface. The present invention is not limited to this embodiment, and the first reduction rolls 4 and the second reduction rolls 5 can be provided with both surfaces of the continuous-cast slab.

As shown in FIG. 5, a plurality of the first reduction rolls 4 and the plurality of the second reduction rolls 5 can be used. In this case, preferably, each pitch between adjacent reduction rolls is same as that between support rolls of the continuous casting equipment.

3. Method of Manufacturing Continuous-Cast Slab 1 According to Present Invention The method of manufacturing the continuous-cast slab 1 according to the present invention includes the first step of forming the first reduction dent 2 on the cast slab and the second step of forming the second reduction dent 3 thereon.

Such two-stage reduction makes it possible to reduce the maximum porosity volume of the slab to a low level without applying an excessive load to reduction rolls.

(1) First Step

In the first step, the wide first reduction dent 2 is formed at least on one long side surface of the cast slab by reduction on the cast slab with the above described first reduction rolls 4.

Preferably, the first reduction rolls 4 are provided with a zone where the fraction solid is 0.3 to 0.7. That is, preferably, the first step is carried out in a zone where the fraction solid of the cast slab is 0.3 to 0.7.

In the first step, reduction with the first reduction rolls 4 is carried out on the cast slab of 0.1 to 0.3 in ratio D/W of the casting thickness D to the casting width W, 230 to 380 mm in casting thickness D, which has horizontally symmetrical granular equiaxed crystals at least in the center in the thickness direction, so that the dent amount $d_1$ of the first reduction dent 2 from an end surface of the cast slab is 0.08 to 1.1 mm. This reduction is also carried out so that the dent rate of the first reduction dent 2 from an end surface of the cast slab, to the casting thickness D is 0.03 to 0.36%.

(2) Second Step

In the second step, the narrow second reduction dent 3 is formed by further reduction with the above described second reduction rolls 5 on the bottom surface of the first reduction dent 2, which is formed in the first step.

Preferably, the second reduction rolls 5 are provided with a zone where the fraction solid is 0.7 to 1.0 in the downstream side of the first reduction rolls 4. That is, preferably, the second step is carried out downstream from the first step in a zone where the fraction solid of the cast slab is 0.7 to 1.0.

In the second step, reduction with the second reduction rolls 5 is carried out on the cast slab of 0.1 to 0.3 in ratio D/W of the casting thickness D to the casting width W, 230 to 380 mm in casting thickness D, which has horizontally symmetrical granular equiaxed crystals at least in the center in the thickness direction, so that the dent amount $d_2$ of the second reduction dent 3 from the bottom surface of the first reduction dent 2 is 1.2 to 12 mm. This reduction is also carried out so that the dent rate of the second reduction dent 3 from the bottom surface of the first reduction dent 2, to the casting thickness D is 0.6 to 4%.

Specifying the dent rate and dent amount of the first reduction dent 2, and those of the second reduction dent 3 makes it possible to reduce the maximum porosity volume of the slab to a low level with no more than $1.5\times10^{-4}$ $cm^3/g$.

4. Apparatus 0 of Manufacturing Thick Steel Plate

Figure 6:
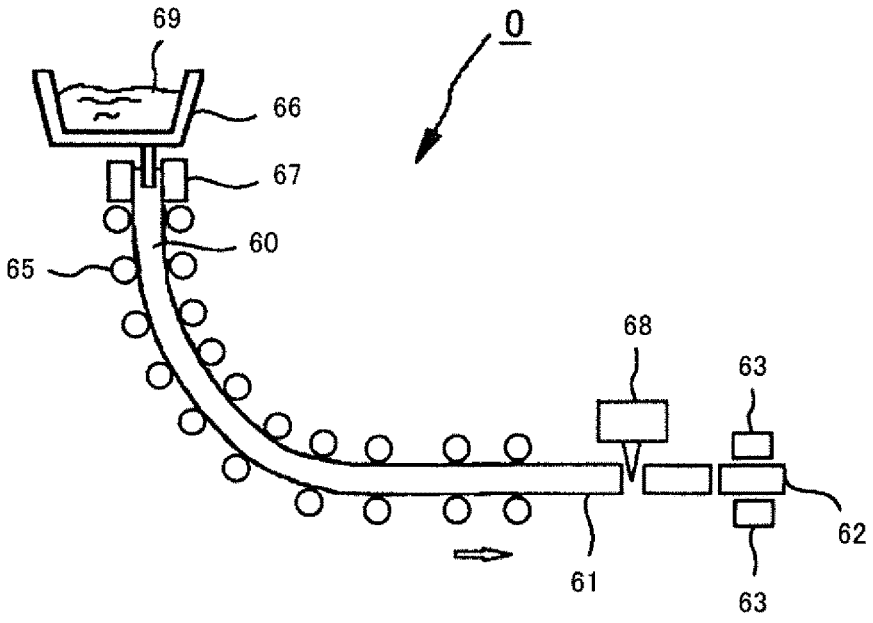
FIG. 6 is an explanatory view schematically showing the structure of an apparatus 0 of manufacturing a thick steel plate of the present invention.

FIG. 6 is an explanatory view schematically showing the structure of the apparatus 0 of manufacturing a thick steel plate according to the present invention. FIG. 5 is an explanatory view of the apparatus of manufacturing the continuous-cast slab which is provided with the apparatus 0 of manufacturing a thick steel plate. In FIG. 6, the first reduction rolls 4, the second reduction rolls 5 and support rolls are denoted as rolls 65 without distinction. Details on the rolls are illustrated in FIG. 5. In FIG. 5, the first reduction rolls 4 and the second reduction rolls 5 are arranged beneath a mold 69 of the continuous casting equipment. FIG. 5 shows an aspect that reduction is carried out on the cast slab in the thickness direction in the vicinity of the solidification end point.

As shown in FIGS. 5 and 6, the apparatus 0 of manufacturing a thick steel plate according to the present invention includes the apparatus of manufacturing the continuous-cast slab of the present invention including the first reduction rolls 4 and the second reduction rolls 5, and a rolling mill 63.

A continuous-cast slab 61 where the maximum porosity volume is no more than $2.5\times10^{-4}$ $cm^3/g$ and segregation is reduced is manufactured using the first reduction rolls 4 and the second reduction rolls 5 provided with the continuous casting equipment. Rolling is carried out on this continuous-cast slab 61 by the rolling mill 63 provided in the downstream side of the continuous casting equipment under the condition that the maximum shape factor is 0.2 to 0.65. Whereby, a thick steel plate 62 that has a level with passing ultrasonic testing is manufactured.

As shown in FIG. 6, in the apparatus 0 of manufacturing a thick steel plate according to the present invention, molten steel 69 that is poured from a ladle not shown to a tundish 66 is poured into a (water-cooled) mold 67, and a solidified shell forms in the mold 67, to be a cast slab 60 having an unsolidified portion inside. The cast slab 60 is withdrawn by a plurality of the rolls 65 (in detail, support rolls, the first reduction rolls 4 and the second reduction rolls 5) toward the downstream side while being cooled, and at the same time, reduction is carried out thereon, to manufacture the continuous-cast slab 61. After that, the continuous-cast slab 61 is cut into a predetermined length by a cutting machine 68, inserted into a furnace and heated to a predetermined temperature, and then, rolling is carried out thereon with the rolling mill 63 to be a slab, to manufacture the steel plate 62.

The first reduction rolls 4 and the second reduction rolls 5 are as described above. Thus, the rolling mill 63 will be described in detail hereinafter.

(1) Rolling Mill 63

The rolling mill 63 rolls the cast slab within the range of 0.2 to 0.65 in maximum shape factor. Preferably, the rolling mill 63 is configured so that the rolled steel plate thickness to the casting thickness D is 50% to 80%.

Specifically, the rolling mill 63 is preferably provided so that the steel plate thickness after rolling the cast slab of 230 to 380 mm in casting thickness D and 0.1 to 0.3 in ratio D/W of the casting thickness D to the casting width W, which has horizontally symmetrical granular equiaxed crystals at least in the center in the thickness direction is 150 to 300 mm.

Heating to preferably 1050 to 1240° C., and more preferably 1050 to 1230° C. is applicable to rolling conditions. Conventionally, heavy rolling of no less than 0.7 in shape factor γ is necessary, and thus the cast slab has to be heated at a high temperature to 1250° C. or more. In contrast, according to the present invention, the thick steel plate where internal flaws due to central porosity are reduced to a level with passing ultrasonic testing can be manufactured even at 1240° C. or less. In addition, it is not necessary to heat the cast slab at a high temperature to 1250° C. or more as conventional one, and thus, the manufacturing costs can be greatly reduced.

The rolling mill 63 is not especially limited, and a well-known rolling mill is applicable. Because such a rolling mill is well-known and commonly used for the person skilled in the art, the specification of the rolling mill 63 is omitted.

According to the present invention, the continuous-cast slab 61 where central porosity and segregation are reduced can be obtained by reduction with the first reduction rolls 4 and the second reduction rolls 5, and thus, it is not necessary to carry out heavy rolling by the rolling mill 63.

5. Method of Manufacturing Thick Steel Plate

The method of manufacturing a thick steel plate of the present invention includes a cast slab manufacturing step of manufacturing the continuous-cast slab 61 according to the method of manufacturing the continuous-cast slab of the present invention, and a rolling step of manufacturing the steel plate 62 by rolling the obtained continuous-cast slab 61. The method of manufacturing the continuous-cast slab of the present invention is as described above, and the description thereof is omitted here. The rolling step will be described hereinafter.

<Rolling Step>

In the rolling step, the continuous-cast slab 61 where central porosity and segregation are reduced, which is obtained in the cast slab manufacturing step of manufacturing the continuous-east slab 61 according to the method of manufacturing the continuous-cast slab of the present invention, is rolled by the above described rolling mill 63 within the range of 0.2 to 0.65 in maximum shape factor.

Preferably, by the rolling step, the steel plate thickness to the casting thickness D after the rolling step is ended is 50% to 80%.

Preferably, rolling is carried out in the rolling step so that the steel plate thickness after the rolling step is 150 to 300 mm.

The maximum porosity volume of a cast slab manufactured with a conventional method is approximately $6\times10^{-4}$ $cm^3/g$ or more. Thus, conventionally, the cast slab cannot pass ultrasonic testing unless heavy rolling of 0.7 or more in maximum shape factor is carried out thereon besides heating the cast slab at a high temperature. In contrast, the central porosity volume of the cast slab manufactured according to the method of manufacturing the continuous-cast slab of the present invention is held down to be no more than $2.5\times10^{-4}$ $cm^3/g$. Therefore, the thick steel plate where central porosity is reduced to a level with passing ultrasonic testing can be manufactured by rolling within the range of 0.2 to 0.65 in maximum shape factor in the rolling step. In this case, conventional heating to no more than 1240° C. has only to be carried out on the cast slab. Thus, the manufacturing costs can be reduced. Here, the maximum shape factor means the shape factor of the maximum value in one pass in a case where hot-rolling is carried out on a thick steel plate with multi passes.

The thick steel plate manufactured according to the present invention is a thick steel plate where internal flaws caused by central porosity are reduced to a level with passing ultrasonic testing. Moreover, this thick steel plate has the advantage of its possible manufacturing at lower cost than conventional one.

6. Thick Steel Plate Manufactured According to Present Invention

The thick steel plate manufactured according to the present invention is a hot-rolled steel plate of no less than 150 mm in thickness. The thick steel plate manufactured according to the present invention is a thick steel plate where internal flaws detected through ultrasonic testing are a few, and thus, preferably used for a nuclear reactor, a boiler, a pressure vessel or the like.

EXAMPLES

Examples of the present invention will be described hereinafter. The present invention is not limited to such Examples.

1) Casting Test for Continuous-East Slab

A cast slab of 300 mm in casting thickness D, 2000 mm in casting width W and 0.15 in D/W value was cast in vertical type continuous casting equipment while subjected to strand-electromagnetic stirring of 0.05 to 0.2 in center fraction solid fs.

Reduction was carried out on the cast slab with six wide reduction rolls arranged at certain pitches in a zone where the fraction solid of the cast slab was 0.3 to 0.7. Reduction was further carried out thereon with three narrow reduction rolls arranged at certain pitches downstream from the above mentioned zone in a zone where the fraction solid of the cast slab was 0.7 to 1.0.

The fraction solid was obtained by heat transfer calculation according to the common finite difference method.

On a surface of the cast slab (slab) cast by the vertical type continuous casting equipment, a wide first reduction dent of 200 mm in distance from an end surface of the cast slab, and a narrow second reduction dent of 300 mm in distance from an end surface of the cast slab were formed. The dent amount of the first reduction dent from an end surface of the cast slab was 0.4 mm. The dent amount of the second reduction dent from the first reduction dent was 3.8 mm.

The dent rate of the first reduction dent from an end surface of the cast slab was 0.13%. The dent rate of the second reduction dent from the first reduction dent was 1.27%.

A sample of 50 mm in length, 100 mm in width and 7 mm in thickness was cut out from each ¼ thickness portion and center part of this slab, and the central porosity volume Pv was obtained with the above described method. The maximum value thereof was $1.0\times10^{-4}$ $cm^3/g$. This value was one sixth of that of a conventional slab.

Figure 3:
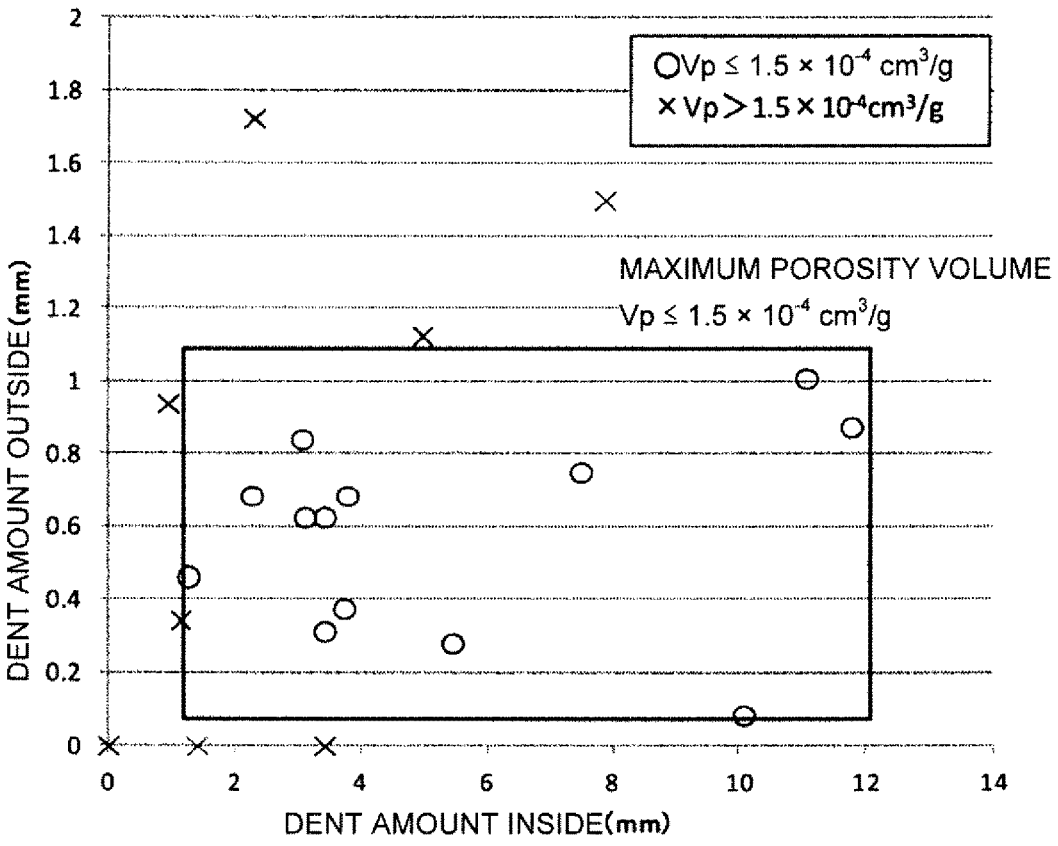
FIG. 3 is a graph showing the influence of the dent amount of the first reduction dent and the dent amount of the second reduction dent on the central porosity volume.

Other than the above, test casting was carried out on cast slabs of 230 to 380 mm in casting thickness D, 1500 to 2400 mm in casting width W and 0.1 to 0.3 in D/W, which have horizontally symmetrical granular equiaxed crystals at least in each center in the thickness direction. In this test casting, the dent amounts were variously changed, and each central porosity volume was obtained in the same way. The results are shown in the graph of FIG. 3. In FIG. 3, the vertical axis shows the dent amount $d_1$ (mm) of the first reduction dent and the horizontal axis shows the dent amount $d_2$ (mm) of the second reduction dent. In this test casting, a range where the maximum central porosity volume of the cast slab was no more than $1.5\times10^{-4}$ $cm^3/g$ is surrounded by a solid line.

Figure 4:
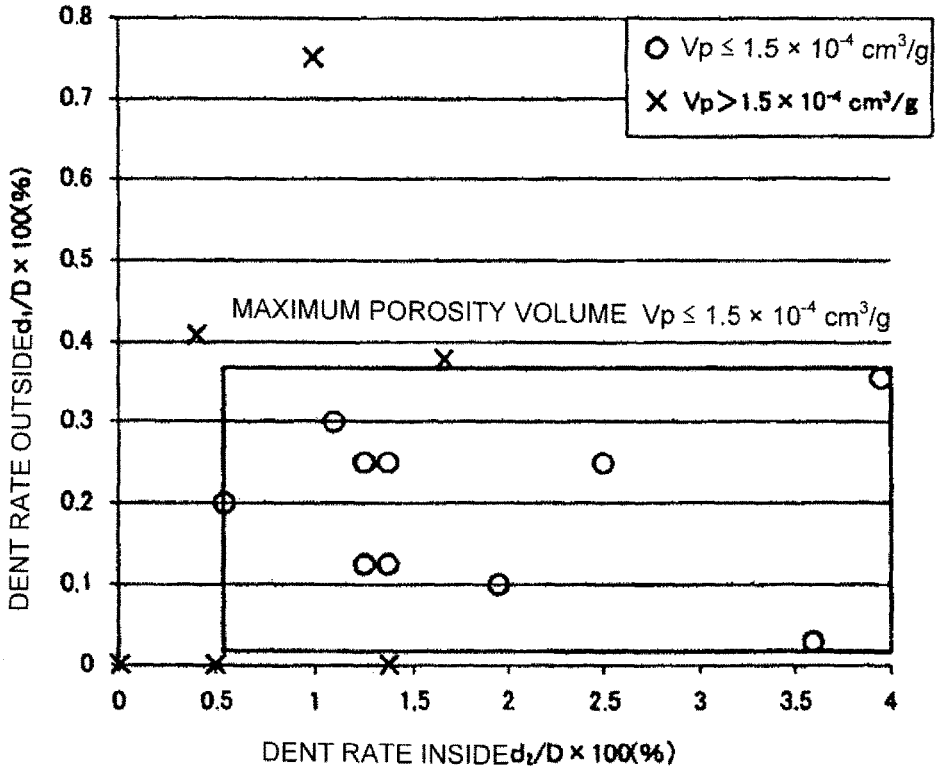
FIG. 4 is a graph showing the influence of the dent rate of the first reduction dent and the dent rate of the second reduction dent on the central porosity volume.

The graph in FIG. 4 shows the results represented by the vertical axis showing the dent rate of the first reduction dent and the horizontal axis showing the dent rate of the second reduction dent. In this test casting, a range where the maximum central porosity volume of the cast slab was no more than $1.5\times10^{-4}$ $cm^3/g$ is surrounded by a solid line. The dent rate of the first reduction dent is $d_1/D$ and the dent rate of the second reduction dent is $d_2/D$ where the cast slab thickness is D mm, the dent amount of the first reduction dent is $d_1$, and the dent amount of the second reduction dent from the bottom surface of the first reduction dent is $d_2$. However, because values of both dent rates are small, the vertical axis and the horizontal axis in FIG. 4 show the values 100 times as large as original ones, which is converted into a percentage.

<Evaluation>

It was confirmed that the maximum porosity volume of the slab was reduced to a low level according to the present invention.

Specifically, it was confirmed that to specify the dent rate and the dent amount of the first reduction dent and those of the second reduction dent made it possible to reduce the maximum porosity volume of the slab to a low level with no more than $1.5\times10^{4}$ $cm^3/g$. The central porosity volume Pv of a conventional slab was 6 to $10\times10^{-4}$ $cm^3/g$. Thus, according to this result, it was confirmed that the cast slab whose maximum central porosity volume was reduced to no more than a fraction of a conventional one was able to be provided.

2) Manufacturing Test for Thick Steel Plate

A cast slab whose casting thickness D, casting width W and D/W satisfied the conditions shown in Table 1, which had horizontally symmetrical granular equiaxed crystals at least in the center in the thickness direction was cast in vertical type continuous casting equipment. Reduction was carried out on the cast slab with six first reduction rolls (250 mm in diameter) arranged in a zone where the fraction solid of the cast slab was as shown in Table 1. Reduction was further carried out with three second reduction rolls (500 mm in diameter) arranged in a zone where the fraction solid of the cast slab was as shown in Table 1, downstream from the first reduction rolls. Conditions of the first reduction rolls and the second reduction rolls such as the dent amount and the dent rate were as shown in Table 1. Rolls whose reduction width was narrower than the casting width W and whose distance from an end surface of the cast slab was within the range of 105 to 320 mm were used as the first reduction rolls. Rolls whose reduction width was narrower than that of the first reduction rolls and whose distance from an end surface of the cast slab was within the range of 155 to 370 mm were used as the second reduction rolls. The second reduction rolls having a larger diameter than the first reduction rolls had were used in order to make it easy to carry out reduction to the center in the thickness direction of the cast slab when the reduction was carried out on the cast slab at a lower temperature than with the first reduction rolls.

A sample of 50 mm in length, 100 mm in width and 7 mm in thickness was cut out from each ¼ thickness portion and center part of the cast slab (slab), and the central porosity volume was obtained with the above described method. The obtained central porosity volume was as shown in Table 2.

Next, a thick steel plate was manufactured by heating each cast slab (slab) and carrying out rolling of various shape factors as shown in Table 1 using rolls of 600 mm in diameter. Heating conditions were as shown in Table 2.

Ultrasonic testing was carried out on obtained each thick steel plate of 150 to 300 mm in thickness. An ultrasonic testing method is defined by "Ultrasonic testing of steel plates for pressure vessels" in JIS G 0801:2008. In this testing, "Standard A" and "Standard B", which were stricter standards as shown in Table 3, were used to decide whether to pass the testing.

Comparing "Standard A" and "Standard B", "Standard B" was a stricter standard. Examples mentioned as "Pass Standard B" also passed "Standard A".

TABLE 1

| | | | | | | First Reduction Dent | | | | Second Reduction Dent | | | |
|---|---|---|---|---|---|---|---|---|---|---|---|---|---|
| | Casting Direction D (mm) | Casting Width W (mm) | D/W | Casting Speed Vc (m/min) | Degree of Superheat of Molten Steel (° C.) | Slab End Surface Distance (mm) | Dent Amount d: (mm) | Dent Rate (%) | Fraction Solid | Slab End Surface Distance (mm) | Dent Amount d: (mm) | Dent Rate (%) | Fraction Solid |
| Example 1 | 230 | 2120 | 0.11 | 0.36 | 28 | 200 | 0.46 | 0.20 | 0.3-0.7 | 250 | 1.4 | 0.61 | 0.7-1.0 |
| Example 2 | 250 | 2120 | 0.12 | 0.31 | 40 | 200 | 0.31 | 0.12 | 0.3-0.7 | 250 | 3.44 | 1.38 | 0.7-1.0 |
| Example 3 | 250 | 2050 | 0.12 | 0.31 | 36 | 165 | 0.63 | 0.25 | 0.3-0.7 | 215 | 3.13 | 1.25 | 0.7-1.0 |
| Example 4 | 280 | 2120 | 0.13 | 0.25 | 35 | 200 | 0.84 | 0.30 | 0.3-0.7 | 250 | 3.08 | 1.1 | 0.7-1.0 |
| Example 5 | 280 | 1930 | 0.15 | 0.25 | 37 | 105 | 0.28 | 0.10 | 0.3-0.7 | 155 | 5.46 | 1.95 | 0.7-1.0 |
| Example 6 | 280 | 1930 | 0.15 | 0.25 | 35 | 105 | 0.08 | 0.03 | 0.3-0.7 | 155 | 10.08 | 3.6 | 0.7-1.0 |
| Example 7 | 280 | 2120 | 0.13 | 0.25 | 38 | 200 | 1.01 | 0.36 | 0.3-0.7 | 250 | 11.06 | 3.95 | 0.7-1.0 |
| Example 8 | 300 | 1890 | 0.16 | 0.22 | 31 | 295 | 0.75 | 0.25 | 0.3-0.7 | 345 | 7.5 | 2.5 | 0.7-1.0 |
| Example 9 | 300 | 1890 | 0.16 | 0.22 | 31 | 295 | 0.75 | 0.25 | 0.3-0.7 | 345 | 7.5 | 2.5 | 0.7-1.0 |
| Example 10 | 380 | 1320 | 0.29 | 0.16 | 40 | 295 | 0.68 | 0.18 | 0.3-0.7 | 345 | 3.8 | 1 | 0.7-1.0 |
| Example 11 | 380 | 2120 | 0.18 | 0.16 | 32 | 200 | 0.68 | 0.18 | 0.3-0.7 | 250 | 2.28 | 0.6 | 0.7-1.0 |
| Example 12 | 380 | 2360 | 0.16 | 0.16 | 36 | 320 | 0.87 | 0.23 | 0.3-0.7 | 370 | 6.3 | 1.66 | 0.7-1.0 |
| Example 13 | 250 | 2050 | 0.12 | 0.31 | 38 | 165 | 0.63 | 0.25 | 0.3-0.7 | 215 | 3.44 | 1.38 | 0.7-1.0 |
| Example 14 | 380 | 2360 | 0.16 | 0.16 | 31 | 320 | 0.87 | 0.23 | 0.3-0.7 | 370 | 11.78 | 3.1 | 0.7-1.0 |
| Example 15 | 380 | 2360 | 0.16 | 0.16 | 31 | 320 | 0.87 | 0.23 | 0.3-0.7 | 370 | 6.3 | 1.66 | 0.7-1.0 |
| Comparative Example a | 230 | 2120 | 0.11 | 0.28 | 30 | 200 | 0.46 | 0.20 | 0.3-0.7 | 250 | 0 | 0 | 0.7-1.0 |
| Comparative Example b | 250 | 2050 | 0.12 | 0.35 | 39 | 165 | 1 | 0.40 | 0.2-0.5 | 215 | 10.5 | 4.2 | 0.5-0.7 |
| Comparative Example c | 280 | 1930 | 0.15 | 0.18 | 44 | 105 | 0 | 0.00 | 0.7-1.0 | 155 | 0 | 0 | 1.0 |
| Comparative Example d | 300 | 1890 | 0.16 | 0.22 | 53 | 295 | 0 | 0.00 | 0.3-0.7 | 345 | 7.5 | 2.5 | 0.7-1.0 |
| Comparative Example e | 380 | 2360 | 0.16 | 0.16 | 40 | 320 | 0.87 | 0.23 | 0.3-0.7 | 370 | 6 | 1.58 | 0.7-1.0 |
| Comparative Example f | 250 | 2050 | 0.12 | 0.31 | 35 | 165 | 0 | 0.00 | 0.3-0.7 | 215 | 9.2 | 3.68 | 0.7-1.0 |
| Comparative Example g | 380 | 1320 | 0.29 | 0.16 | 40 | 320 | 0 | 0.00 | 0.7-1.0 | 370 | 0 | 0 | 1.0 |
| Comparative Example h | 380 | 2360 | 0.16 | 0.16 | 40 | 320 | 0.87 | 0.23 | 0.3-0.7 | 370 | 0 | 0 | 0.7-1.0 |
| Comparative Example i | 380 | 2120 | 0.18 | 0.16 | 30 | 200 | 0.46 | 0.12 | 0.3-0.7 | 250 | 0 | 0 | 0.7-1.0 |
| Comparative Example j | 230 | 2120 | 0.11 | 0.28 | 61 | — | 2.2 | 0.96 | 0.3-0.7 | — | — | — | — |
| Comparative Example k | 300 | 1890 | 0.16 | 0.22 | 65 | — | 2.7 | 0.90 | 0.3-0.7 | 345 | 15 | 5 | 0.7-1.0 |
| Comparative Example l | 300 | 1890 | 0.16 | 0.22 | 31 | — | 4.5 | 1.50 | 0.3-0.7 | 345 | 14 | 4.67 | 0.7-1.0 |
| Comparative Example m | 280 | 1930 | 0.15 | 0.25 | 35 | 105 | 0.05 | 0.02 | 0.3-0.7 | 155 | 9.8 | 3.5 | 0.7-1.0 |
| Comparative Example n | 380 | 2120 | 0.18 | 0.16 | 32 | 200 | 0.48 | 0.13 | 0.3-0.7 | 250 | 2.2 | 0.58 | 0.7-1.0 |
| Comparative Example o | 280 | 2120 | 0.13 | 0.25 | 38 | 200 | 1.5 | 0.54 | 0.3-0.7 | 250 | 13.2 | 4.71 | 0.7-1.0 |

In Table 1, "Degree of Superheat of Molten Steel (° C.)" is a temperature added to the liquidus temperature that is determined by components of steel in a tundish. In Examples 1 to 15 and Comparative Examples a to i, m and n, rolls of convex surfaces were used as the first reduction rolls and the second reduction rolls. On the other hand, in Comparative Example j, rolls of smooth surfaces were used as the first reduction rolls, and no second reduction rolls were used. In Comparative Examples k to 1, rolls of smooth surfaces were used as the first reduction rolls and the second reduction rolls.

In every Example and Comparative Example, the value shown in Table 1 was multiplied by "$10^{-4}$", to be the dent amount.

TABLE 2

| | | | | | Configuration of Thickness Center Solidification | | | | | | | |
|---|---|---|---|---|---|---|---|---|---|---|---|---|
| | Heating Temp (° C.) | Maximum Shape Factor | Steel Plate Thickness (mm) | Reduction Rate (%) | Solidifying Structure | Equiaxed Crystal Ratio (%) | Equiaxed Crystal Diameter (mm) | Uniformity | Maximum Segregation Thickness (mm) | Porosity Volume ($cm^3/g$) | Ultrasonic Testing Result | Overall Evaluation |
| Example 1 | 1230 | 0.63 | 150 | 34.8 | Granular | 15.2 | 0.6 | Uniform | 0.25 | 1.88 | Pass B | Pass |
| Example 2 | 1220 | 0.63 | 150 | 40.0 | Granular | 22.0 | 0.8 | Uniform | 0.5 | 1.88 | Pass B | Pass |
| Example 3 | 1225 | 0.63 | 150 | 40.0 | Granular | 23.5 | 0.7 | Uniform | 0.5 | 1.16 | Pass B | Pass |
| Example 4 | 1140 | 0.41 | 210 | 25.0 | Granular | 25.6 | 0.8 | Uniform | 0.25 | 1.00 | Pass B | Pass |
| Example 5 | 1110 | 0.37 | 210 | 25.0 | Granular | 25.0 | 0.8 | Uniform | 0.25 | 0.73 | Pass B | Pass |
| Example 6 | 1180 | 0.46 | 210 | 25.0 | Granular | 24.8 | 0.8 | Uniform | 0.25 | 1.00 | Pass B | Pass |
| Example 7 | 1170 | 0.44 | 210 | 25.0 | Granular | 25.3 | 0.8 | Uniform | 0.5 | 0.75 | Pass B | Pass |

TABLE 2-continued

| | Heating Temp (° C.) | Maximum Shape Factor | Steel Plate Thickness (mm) | Reduction Rate (%) | Configuration of Thickness Center Solidification: Solidifying Structure | Equiaxed Crystal Ratio (%) | Equiaxed Crystal Diameter (mm) | Uniformity | Maximum Segregation Thickness (mm) | Porosity Volume ($cm^3/g$) | Ultrasonic Testing Result | Overall Evaluation |
|---|---|---|---|---|---|---|---|---|---|---|---|---|
| Example 8 | 1130 | 0.41 | 210 | 30.0 | Granular | 31.2 | 0.9 | Uniform | 0.5 | 1.00 | Pass B | Pass |
| Example 9 | 1210 | 0.55 | 170 | 43.3 | Granular | 28.8 | 0.9 | Uniform | 0.25 | 0.75 | Pass B | Pass |
| Example 10 | 1150 | 0.42 | 260 | 31.6 | Granular | 51.0 | 1.3 | Uniform | 0.25 | 0.75 | Pass B | Pass |
| Example 11 | 1120 | 0.37 | 300 | 21.1 | Granular | 52.5 | 1.2 | Uniform | 0.25 | 0.75 | Pass B | Pass |
| Example 12 | 1230 | 0.64 | 200 | 47.4 | Granular | 19.6 | 1.2 | Uniform | 0.5 | 2.72 | Pass B | Pass |
| Example 13 | 1230 | 0.53 | 170 | 32.0 | Granular | 22.2 | 0.7 | Uniform | 0.25 | 1.88 | Pass A | Pass |
| Example 14 | 1050 | 0.20 | 300 | 21.1 | Granular | 49.1 | 1.2 | Uniform | 0.25 | 1.00 | Past A | Pass |
| Example 15 | 1230 | 0.53 | 200 | 47.4 | Granular | 50.0 | 1.2 | Uniform | 0.25 | 2.72 | Pass A | Pass |
| Comparative Example a | 1230 | 0.55 | 150 | 34.8 | Granular | 15.7 | 2.1 | Ununiform | 1.5 | 5.89 | x | Fail |
| Comparative Example b | 1150 | 0.43 | 170 | 32.0 | Granular | 23.5 | 0.8 | Uniform | 0.75 | 2.90 | x | Fail |
| Comparative Example c | 1120 | 0.33 | 210 | 25.0 | Granular | 31.0 | 0.9 | Uniform | 1.5 | 2.96 | x | Fail |
| Comparative Example d | 1230 | 0.53 | 210 | 30.1 | Granular | 30.4 | 1.1 | Uniform | 1 | 2.89 | x | Fail |
| Comparative Example e | 1230 | 0.51 | 320 | 15.8 | Granular | 28.5 | 1.3 | Uniform | 0.5 | 2.90 | x | Fail |
| Comparative Example f | 1260 | 0.70 | 150 | 40.0 | Granular | 20.8 | 0.8 | Uniform | 1 | 5.89 | Pass A | Fail |
| Comparative Example g | 1255 | 0.70 | 150 | 60.5 | Granular | 47.0 | 1.3 | Uniform | 1 | 2.96 | Pass B | Fail |
| Comparative Example h | 1255 | 0.71 | 150 | 60.5 | Granular | 48.6 | 1.4 | Uniform | 0.25 | 2.96 | Pass B | Fail |
| Comparative Example i | 1270 | 0.80 | 150 | 60.5 | Granular | 49.5 | 1.3 | Uniform | 0.25 | 5.89 | Pass B | Fail |
| Comparative Example j | 1230 | 0.55 | 150 | 34.8 | Branching Dendrites | 7.3 | 5.7 | Uniform | 1.5 | 5.89 | x | Fail |
| Comparative Example k | 1130 | 0.41 | 210 | 30.0 | Branching Dendrites | 31.2 | 6.2 | Uniform | 1.5 | 3.20 | x | Fail |
| Comparative Example l | 1210 | 0.55 | 170 | 43.3 | Granular | 21.2 | 0.9 | Uniform | 1 | 2.75 | x | Fail |
| Comparative Example m | 1180 | 0.46 | 210 | 25.0 | Granular | 19.3 | 2.3 | Ununiform | 1.25 | 2.88 | x | Fail |
| Comparative Example n | 1120 | 0.37 | 300 | 21.1 | Granular | 18.5 | 3.7 | Ununiform | 1.25 | 3.05 | x | Fail |
| Comparative Example o | 1170 | 0.44 | 210 | 25.0 | Granular | 25.3 | 0.8 | Uniform | 1.5 | 6.10 | x | Fail |

In Table 2, "Configuration of Thickness Center Solidification" shows results that: a sample was cut out from the cast slab after the cast slab manufacturing step before the rolling step, and solidifying structure that emerged using an etchant prepared with cupric chloride, aqueous solution saturated with picric acid, and hot water at 80° C. was observed in an equiaxed crystal zone of 50 mm in cast slab width center and 100 mm in ½ thickness.

Figure 7:
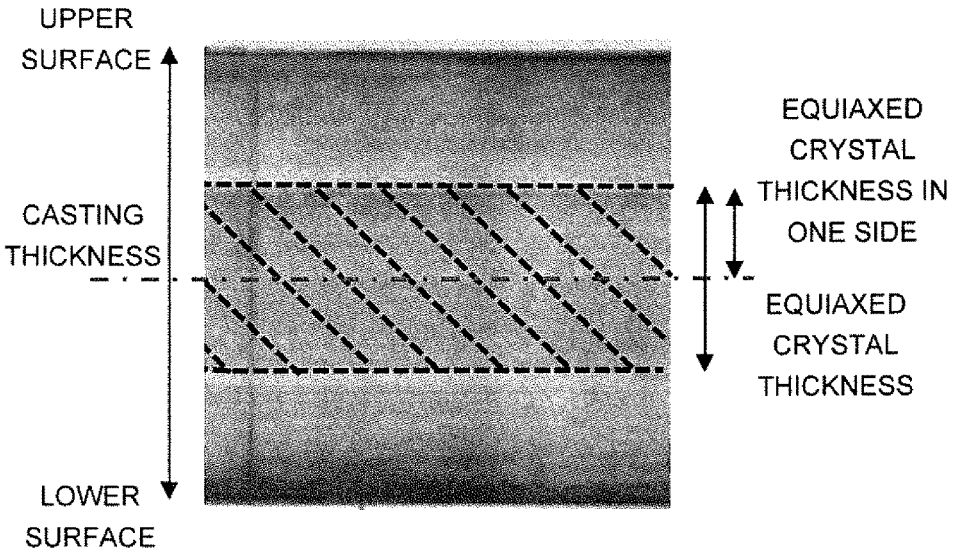
FIG. 7 is a schematic explanatory view of a transversal cross section of the cast slab.

"Equiaxed Crystal Ratio (%)" is a proportion of thickness of a zone in the top half of the cast slab in the thickness direction where equiaxed crystals formed, to the ½ thickness of the cast slab. "Equiaxed Crystal Diameter (mm)" is a mean value of equivalent circle diameters of approximately 100 equiaxed crystals that were measured by binarization image processing on the solidifying structure. In "Uniformity of Solidifying Structure", "Uniform" means that difference between the equiaxed crystal ratios of the upper half and the lower half of the cast slab bordered by the thickness center of the cast slab was no more than 5%, and "Ununiform" means that the difference was over 5%. FIG. 7 is a schematic view of a transversal cross section of the cast slab.

Figure 8:
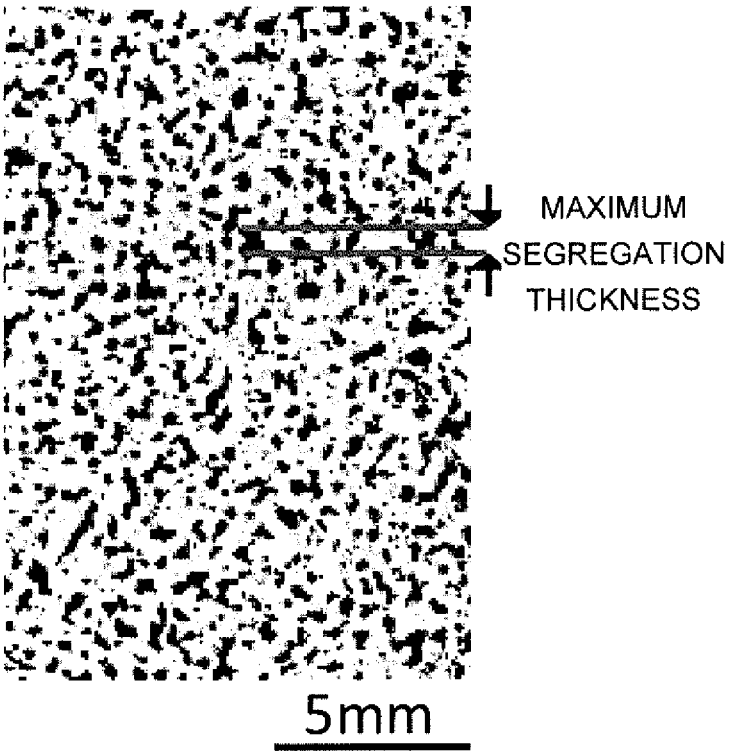
FIG. 8 shows an example of granular crystals and the maximum segregation thickness.
Figure 9:
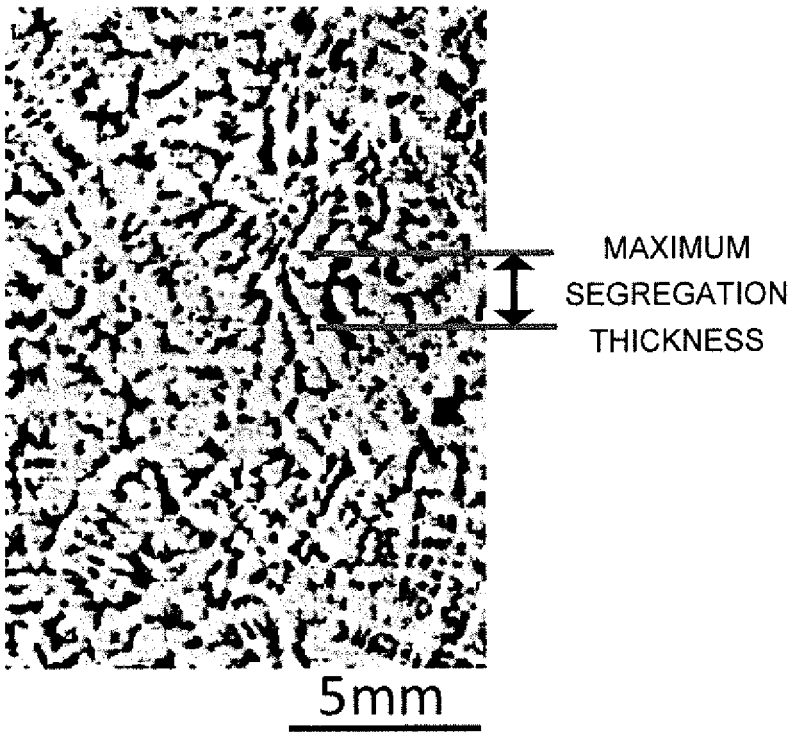
FIG. 9 shows an example of branching dendrites and the maximum segregation thickness.

"Maximum Segregation Thickness" is the maximum value of segregation thickness of a sample cut out from the cast slab after the cast slab manufacturing step before the rolling step, specified by observation on whole of the cast slab in the width direction. FIG. 8 shows an example of granular crystals and the maximum segregation thickness. FIG. 9 shows an example of branching dendrites and the maximum segregation thickness.

The value shown in Table 2 was multiplied by "$10^{-4}$", to be "Porosity Volume".

"Reduction Rate" is a proportion of reduction thickness in the rolling step to the cast slab thickness before rolling (=cast slab thickness before rolling−slab thickness after reduction).

In addition, "x" in each "Ultrasonic Testing Result" field means "Fail A" and "Fail B".

In "Over-all Evaluation", Examples that satisfied "the maximum segregation thickness ≤0.5 mm", "the maximum shape factor <0.7", "the porosity volume $<2.5\times10^{-4}$ $cm^3/g$" and "Ultrasonic Testing Result was other than 'x'" were determined to "pass".

As shown in Tables 1 and 2, the cast slab manufactured with the method of manufacturing the continuous-cast slab of the present invention (hereinafter may be referred to as "cast slab of Example") had uniform and small granular equiaxed crystals of 1.3 mm in diameter. The cast slab of Example was 0.50 mm in maximum segregation thickness, and thus, segregation therein was reduced. Moreover, the cast slab of Example was no more than $2.5\times10^{-4}$ $cm^3/g$ in porosity volume. A conventional cast slab was approximately 6 to $10\times10^{-4}$ $cm^3/g$ in porosity volume. Thus, according to the present invention, the porosity volume was able to be reduced. From these results, it was found that according to the present invention, the continuous-cast slab where central porosity and segregation were reduced during casting was able to be provided.

TABLE 3

| | | | | |
|---|---|---|---|---|
| (0) Flaw Detecting Standard | | JIS G 0801 | Standard A set based on JIS G 0801 listed in left field | Standard B |
| (1) Scope | Thickness (mm) | $6 \le t \le 300$ | $4.5 \le t \le 300$ | $19 \le t \le 250$ |
| (2) Flaw Detection Apparatus | Manual (see another standard for digital apparatuses (auto)) | A scope presentation | A scope presentation | A scope presentation |

TABLE 3-continued

| | | | | |
|---|---|---|---|---|
| | Probe Specification | crystal probe | crystal probe | crystal probe |
| | Working Sensitivity | STB-G V15-2.8: 50% (steel plate thickness 160 ≤ t ≤ 200) | STB-G V15-2.8: 50% (steel plate thickness 160 ≤ t ≤ 200) | STB-G V15-2.0: 40 to 50% (steel plate thickness 150 ≤ t ≤ 250) |
| | Nominal Frequency (MHz) | 2 | 2 | 2 |
| | Transducer Effective Diameter (mm) | 30 | 30 | 28 to 30 |
| (3) Flaw Detecting Area | | scanning classification A | scanning classification A within 50 mm in cricumference or within 25 mm ± lines to be grooved | scanning classification S all-over continuous detection around faults or 100 mm in circumference of lines to be grooved |
| (4) Classification of Flaws | | | | |
| (1) Echo Height $F^1$ or $F^1/B^1$ | Light (○ Flaw) | more than 25% and no more than 50% | more than 12.5% and no more than 25% | more than 10% and no more than 50% |
| | Middle (Δ Flaw) | more than 50% and no more than 100% | more than 25% and no more than 50% | more than 50% and no more than 100% |
| | Heavy (X Flaw) | more than 100% | more than 50% | more than 100% |
| (2) Measurement Limit of Fault Presentation Length (Measure Center Distance of Probe) | Light (○ Flaw) | 25% | 12.5% | 10% |
| | Middle (Δ Flaw) | 50% | 25% | 50% |
| | Heavy (X Flaw) | 50% | 50% | 100% |
| (5) Judgment Criteria | | Conform to JIS G 0801 | Conform to JIS G 0801 | satisfy the following flaw length and area rate: No flaw of no less than 15 mm in length 1, no more than 3 flaws per 100 $cm^2$ of more than 5 mm and no more than 15 mm in length 1, and no more than 2 flaws per 100 $cm^2$ of no more than 5 mm in length 1 Flaw area rate S ≤ 5% ($F_1$ ≥ 50%) and S ≤ 10% $F_1$ < 50%) |

Figure 10:
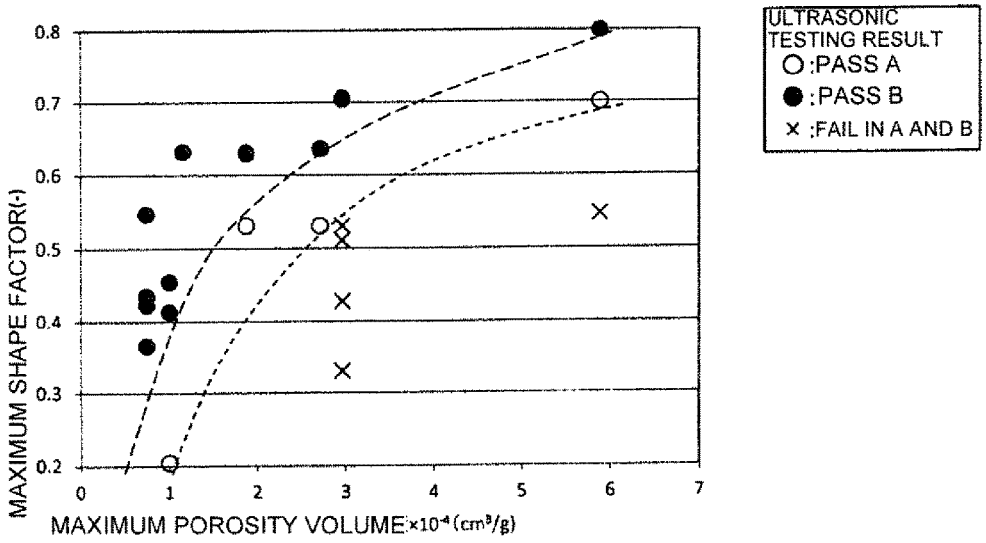
FIG. 10 is a graph showing the relationship between the maximum porosity volume, the maximum shape factor upon rolling with rolls, and a pass or fail of ultrasonic testing.

FIG. 10 is a graph showing the relationship between the maximum porosity volume, the maximum shape factor upon rolling with rolls, and a pass or fail of ultrasonic testing.

As shown in the distribution map of FIG. 10, when a conventional cast slab of approximately $6\times10^{-4}$ $cm^3/g$ in maximum porosity volume was used, it was impossible to pass ultrasonic testing by Standard A unless heavy rolling of no less than 0.7 in maximum shape factor was carried out. It was also impossible to pass ultrasonic testing by Standard B unless heavy rolling of no less than 0.7 in maximum shape factor was carried out even when the cast slab of $3\times10^{-4}$ $cm^3/g$ in maximum porosity volume was used.

In contrast, the cast slabs manufactured by adjusting reduction with the first reduction rolls and the second reduction rolls had no more than $2.5\times10^{-4}$ $cm^3/g$ in maximum porosity volume although some variation arose. When these cast slabs were used, they passed ultrasonic testing even if the maximum shape factor in rolling in the later process was reduced to no more than 0.65 in Standard B.

The heating temperature in the rolling then was within the range of 1050 to 1230° C.

Specifically, it is found that it was possible to satisfy Standard A by reducing the maximum porosity volume to a level with $1.0\times10^{-4}$ $cm^3/g$ even if the maximum shape factor was 0.2 as shown in FIG. 10.

In view of these results, it was found that according to the present invention, a thick steel plate of a level with passing ultrasonic testing was able to be manufactured even if the maximum shape factor in rolling was within the range of 0.2 to 0.65. The heating temperature in rolling might be within the range of 1050 to 1230° C., and it was not necessary for the cast slab to be heated at a high temperature to no less than 1250° C. as a conventional one. Thus, the manufacturing costs of a thick steel plate was able to be greatly reduced.

As described above, according to the present invention, a thick steel plate of a level with passing ultrasonic testing can be manufactured at low cost without heavy rolling of no less than 0.7 in shape factor γ.

REFERENCE SIGNS LIST

0: apparatus of manufacturing a thick steel plate
1: continuous-cast slab
2: first reduction dent
3: second reduction dent
4: first reduction rolls
5: second reduction rolls
6: backup rolls
60: cast slab
61: continuous-cast slab
62: steel plate
63: rolling mill
65: rolls
66: tundish
67: mold
68: cutting machine
69: molten steel

The invention claimed is:

1. A continuous-cast slab of 0.1 to 0.3 in ratio D/W, the ratio D/W being a ratio of casting thickness D to casting width W, and 230 to 380 mm in casting thickness D, the continuous-east slab having a horizontally symmetrical granular equiaxed crystals at least in a center in a thickness direction, the continuous-cast slab comprising:

a first reduction dent and a second reduction dent that is narrower than the first reduction dent at least on one long side surface, the second reduction dent denting further from a bottom surface of the first reduction dent, wherein a dent amount $d_1$ of the first reduction dent from an end surface of the continuous-cast slab is 0.08 to 1.1 mm, and a dent amount $d_2$ of the second reduction dent from the bottom surface of the first reduction dent is 1.2 to 12 mm, and/or a dent rate of the first reduction dent from an end surface of the continuous-cast slab, to the casting thickness D is 0.03 to 0.36%, and a dent rate of the second reduction dent from the bottom surface of the first reduction dent, to the casting thickness D is 0.6 to 4%.

2. The continuous-cast slab according to claim 1, wherein distance between either end of the first reduction dent and the end surface of the continuous-cast slab is 0.37×the casting thickness D to 1.0×the casting thickness D, and distance between either end of the second reduction dent and the end surface of the continuous-cast slab is 0.5×the casting thickness D to 1.2×the casting thickness D.

3. The continuous-cast slab according to claim 1, wherein a maximum porosity volume is no more than $1.5\times10^{-4}$ $cm^3/g$.

4. A method of manufacturing a continuous-cast slab, the method comprising:

a first step of forming a first reduction dent at least in one long side surface of the continuous-cast slab by carrying out reduction with first reduction rolls on the continuous-cast slab, the continuous-cast slab being 0.1 to 0.3 in ratio D/W, the ratio D/W being a ratio of casting thickness D to casting width W, and 230 to 380 mm in casting thickness D, the continuous-cast slab having a horizontally symmetrical granular equiaxed crystals at least in a center in a thickness direction; and a second step of forming a second reduction dent that is narrower than the first reduction dent by carrying out further reduction on a bottom surface of the first reduction dent with second reduction rolls that are narrower than the first reduction rolls, wherein in the first step, the reduction is carried out on the continuous-cast slab so that a dent amount $d_1$ of the first reduction dent from an end surface of the continuous-cast slab is 0.08 to 1.1 mm, and in the second step, the reduction is carried out on the continuous-cast slab so that a dent amount $d_2$ of the second reduction dent from the bottom surface of the first reduction dent is 1.2 to 12 mm, and/or wherein in the first step, the reduction is carried out on the continuous-cast slab so that a dent rate of the first reduction dent from an end surface of the continuous-cast slab, to the casting thickness D is 0.03 to 0.36%, and in the second step, the reduction is carried out on the continuous-cast slab so that a dent rate of the second reduction dent from the bottom surface of the first reduction dent, to the casting thickness D is 0.6 to 4%.

5. The method according to claim 4, wherein the first reduction rolls are provided for a zone where a fraction solid is 0.3 to 0.7, and the second reduction rolls are provided for a zone where a fraction solid is 0.7 to 1.0, downstream from the first reduction rolls.

6. The method according to claim 4, wherein distance between either end of the first reduction dent and an end surface of the continuous-cast slab is 0.37×the casting thickness D to 1.0×the casting thickness D, and distance between either end of the second reduction dent and the end surface of the continuous-cast slab is 0.5×the casting thickness D to 1.2×the casting thickness D.

7. The method according to claim 4, wherein a maximum porosity volume of the continuous-cast slab manufactured through the first and second steps is no more than $1.5\times10^4$ $cm^3/g$.

8. An apparatus of manufacturing a continuous-cast slab, the apparatus comprising:

first reduction rolls that shape an intermediate shaped product having a first reduction dent at least on one long side surface of the continuous-cast slab, the continuous-cast slab being 0.1 to 0.3 in ratio D/W, the ratio D/W being a ratio of casting thickness D to casting width W, the continuous-cast slab being 230 to 380 mm in casting thickness D, and having horizontally symmetrical granular equiaxed crystals at least in a center in a thickness direction; and second reduction rolls that shape a second reduction dent denting further from a bottom surface of the first reduction dent of the intermediate shaped product and being narrower than the first reduction dent, the second reduction rolls having shapes narrower than the first reduction rolls and being arranged downstream from the first reduction rolls, wherein the first reduction rolls are provided so that a dent amount $d_1$ of the first reduction dent from an end surface of the continuous-cast slab is 0.08 to 1.1 mm, and the second reduction rolls are provided so that a dent amount $d_2$ of the second reduction dent from the bottom surface of the first reduction dent is 1.2 to 12 mm, and/or the first reduction rolls are provided so that a dent rate of the first reduction dent from an end surface of the continuous-cast slab, to the casting thickness D is 0.03 to 0.36%, and the second reduction rolls are provided so that a dent rate of the second reduction dent from the bottom surface of the first reduction dent, to the casting thickness D is 0.6 to 4%.

9. The apparatus according to claim 8, wherein the first reduction rolls are provided for a zone where a fraction solid is 0.3 to 0.7, and the second reduction rolls are provided for a zone where a fraction solid is 0.7 to 1.0, downstream from the first reduction rolls.

10. The apparatus according to claim 8, wherein the first reduction rolls are provided so that distance between either end of the first reduction dent and the end surface of the continuous-cast slab is 0.37×the casting thickness D to 1.0×the casting thickness D, and the second reduction rolls are provided so that distance between either end of the second reduction dent and the end surface of the continuous-cast slab is 0.5×the casting thickness D to 1.2×the casting thickness D.

11. The apparatus according to claim 8, wherein a maximum porosity volume of the continuous-cast slab is no more than $1.5\times10^{-4}$ $cm^3/g$.

12. A method of manufacturing a thick steel plate comprising:

a continuous-cast slab manufacturing step of manufacturing a continuous-cast slab according to the method of manufacturing a continuous-cast slab of claim 4; and a rolling step of rolling, within the range of 0.2 to 0.65 in maximum shape factor, the continuous-cast slab manufactured in the continuous-cast slab manufacturing step, the continuous-cast slab being no more than $2.5\times10^4$ $cm^3/g$ in maximum porosity volume.

13. The method according to claim 12, wherein steel plate thickness to casting thickness D after the rolling step is ended is 50% to 80% by the rolling step.

14. The method according to claim 12, wherein the steel plate thickness after the rolling step is ended is 150 to 300 mm by the rolling step.

15. An apparatus of manufacturing a thick steel plate, the apparatus comprising:

the apparatus of manufacturing a continuous-cast slab according to claim 8; and a rolling mill that rolls the continuous-cast slab manufactured by the apparatus of manufacturing a continuous-cast slab, wherein the rolling mill rolls, within the range of 0.2 to 0.65 in maximum shape factor, the continuous-cast slab of no more than $2.5\times10^{-4}$ $cm^3/g$ in maximum porosity volume.

16. The apparatus according to claim 15, wherein the rolling mill makes steel plate thickness after said rolling 50% to 80% to casting thickness D.

17. The apparatus according to claim 15, wherein the rolling mill makes steel plate thickness after said rolling 150 to 300 mm.

* * * * *